US010053753B2

(12) United States Patent
Shiragaki et al.

(10) Patent No.: US 10,053,753 B2
(45) Date of Patent: Aug. 21, 2018

(54) ALUMINUM-ZINC PLATED STEEL SHEET AND METHOD FOR PRODUCING THE SAME

(71) Applicants: NIPPON STEEL & SUMIKIN COATED SHEET CORPORATION, Tokyo (JP); NIPPON STEEL & SUMITOMO METAL CORPORATION, Tokyo (JP); NIHON PARKERIZING CO., LTD., Tokyo (JP)

(72) Inventors: Nobuki Shiragaki, Hyogo (JP); Tomokazu Sugitani, Osaka (JP); Hiroyuki Oyokawa, Chiba (JP); Satoru Yonetani, Osaka (JP); Hiroshi Kanai, Singapore (SG); Nobuyuki Shimoda, Tokyo (JP); Ichiro Oura, Tokyo (JP); Hitoshi Kikuchi, Tokyo (JP)

(73) Assignees: NIPPON STEEL & SUMIKIN COATED SHEET CORPORATION, Tokyo (JP); NIPPON STEEL & SUMITOMO METAL CORPORATION, Tokyo (JP); NIHON PARKERIZING CO., LTD., Tokyo (JP)

( * ) Notice: Subject to any disclaimer, the term of this patent is extended or adjusted under 35 U.S.C. 154(b) by 0 days.

(21) Appl. No.: 14/768,364

(22) PCT Filed: Feb. 27, 2014

(86) PCT No.: PCT/JP2014/001067

§ 371 (c)(1),
(2) Date: Aug. 17, 2015

(87) PCT Pub. No.: WO2014/132653

PCT Pub. Date: Sep. 4, 2014

(65) Prior Publication Data

US 2016/0002753 A1 Jan. 7, 2016

(30) Foreign Application Priority Data

Feb. 28, 2013 (JP) ..... 2013-040120

(51) Int. Cl.
*C22C 21/10* (2006.01)
*C23C 2/06* (2006.01)
(Continued)

(52) U.S. Cl.
CPC ..... *C22C 21/10* (2013.01); *C22C 18/04* (2013.01); *C22C 30/06* (2013.01); *C23C 2/06* (2013.01);
(Continued)

(58) Field of Classification Search
CPC ..... C22C 21/10
(Continued)

(56) References Cited

U.S. PATENT DOCUMENTS 3,929,514 A 12/1975 Houlihan et al.
5,318,640 A 6/1994 Ishii et al.
(Continued)

FOREIGN PATENT DOCUMENTS

CA 2 349 376 A1 5/2000
CN 101184867 A 5/2008
(Continued)

OTHER PUBLICATIONS

SilMid, "Product Data Sheet", https://www.silmid.com/MetaFiles/Silmid/fc/fc9b77d0-c790-4103-be50-eac46bdd22d1.pdf, accessed Jun. 1, 2016.*
(Continued)

*Primary Examiner* — Humera N Sheikh
*Assistant Examiner* — Xiaobei Wang
(74) *Attorney, Agent, or Firm* — Cheng Law Group, PLLC

(57) ABSTRACT

The aluminum-zinc plated steel sheet according to the present invention includes a plated steel sheet and a covering
(Continued)

film that covers the plated steel sheet. The covering film contains a basic compound of transition metal other than cobalt and chromium, and metallic cobalt, or metallic cobalt and a cobalt compound. An amount of the covering film per one side is within a range of 0.01 to 0.8 g/m$^2$. An amount in terms of mass of transition metal other than cobalt in the covering film per one side of the plated steel sheet is within a range of 4 to 400 mg/m$^2$. An amount in terms of mass of cobalt in the covering film per one side of the plated steel sheet is within a range of 0.1 to 20 mg/m$^2$.

14 Claims, 4 Drawing Sheets

(51) Int. Cl.

| | |
|---|---|
| ***C22C 18/04*** | (2006.01) |
| ***C22C 30/06*** | (2006.01) |
| ***C23C 2/12*** | (2006.01) |
| ***C23C 22/60*** | (2006.01) |
| ***C23C 22/66*** | (2006.01) |
| ***C23C 22/68*** | (2006.01) |
| ***C23C 2/26*** | (2006.01) |
| ***C23C 28/00*** | (2006.01) |

(52) U.S. Cl.
CPC ..... *C23C 2/12* (2013.01); *C23C 2/26* (2013.01); *C23C 22/60* (2013.01); *C23C 22/66* (2013.01); *C23C 22/68* (2013.01); *C23C 28/321* (2013.01); *C23C 28/34* (2013.01)

(58) Field of Classification Search
USPC ..... 428/668
See application file for complete search history.

(56) References Cited

U.S. PATENT DOCUMENTS

| | | | | |
|---|---|---|---|---|
| 2008/0254283 | A1* | 10/2008 | Shimoda | C25D 13/18 428/336 |
| 2009/0202859 | A1* | 8/2009 | Kimata | C22C 21/10 428/653 |
| 2011/0094630 | A1 | 4/2011 | Yoshida et al. | |
| 2012/0208043 | A1* | 8/2012 | Matsuda | C23C 22/82 428/623 |
| 2012/0325110 | A1* | 12/2012 | Brouwer | C23C 22/78 106/1.22 |
| 2015/0044498 | A1 | 2/2015 | Shiragaki et al. | |

FOREIGN PATENT DOCUMENTS

| | | | |
|---|---|---|---|
| CN | 102084031 | A | 6/2011 |
| EP | 2 821 223 | A1 | 1/2015 |
| JP | 57-39314 82 | | 8/1982 |
| JP | 59-177381 | A | 10/1984 |
| JP | 4-371585 | A | 12/1992 |
| JP | 2003-201578 | A | 7/2003 |
| JP | 2005-232504 | A | 9/2005 |
| JP | 3992173 | B2 | 10/2007 |
| JP | 2009-132952 | A | 6/2009 |
| WO | WO-2007/123278 | A1 | 11/2007 |
| WO | WO-2013/128928 | A1 | 9/2013 |

OTHER PUBLICATIONS

GalvInfoNote 12, <http://www.steelmillsoftheworld.com/activities/datacenter/G_Note12.pdf>, Aug. 2003, accessed Jul. 7, 2017.*
International Search Report for the Application No. PCT/JP2014/001067 dated Apr. 8, 2014.
English Translation of The First Office Action for the Application No. 201480010845.7 from The State Intellectual Property Office of the People's Republic of China dated May 18, 2016.
Supplementary European Search Report for the Application No. EP 14 75 6405 dated Apr. 10, 2017.

* cited by examiner

ALUMINUM-ZINC PLATED STEEL SHEET AND METHOD FOR PRODUCING THE SAME

TECHNICAL FIELD

The present invention relates to an aluminum-zinc plated steel sheet and a method for producing the same.

BACKGROUND ART

A plated steel sheet with plating of an aluminum-zinc alloy (aluminum-zinc plated steel sheet) has a high corrosion resistance compared with a hot-dip galvanized steel sheet. A steel sheet plated with an aluminum-zinc alloy having an aluminum percentage of about 55% by mass, i.e., a high aluminum-content zinc plated steel sheet, has particularly high corrosion resistance, and also has excellent heat resistance and heat reflectivity. Thus, in recent years, aluminum-zinc plated steel sheets have become widely used in building material products such as roofing materials and wall materials, construction materials such as guardrails, sound insulating walls, snow fences, and gutters, materials for cars, home appliances, and industrial equipment, and moreover for use in bases for painted steel sheets.

As a result of the aluminum-zinc plated steel sheet being painted, it has much higher corrosion resistance.

However, the aluminum-zinc plated steel sheets are sometimes stored temporarily before the aluminum-zinc plated steel sheets are painted, resulting in the occurrence of black rust or white rust. If the aluminum-zinc plated steel sheet is stored in a high temperature and high humidity atmosphere, blackening may also occur. In particular, if water droplets adhere to the surface of the aluminum-zinc plated steel sheet due to condensation, blackening is likely to occur selectively in the areas where the water droplets adhere. As a result, not only does the external appearance of the aluminum-zinc plated steel sheet deteriorate, but also the surface composition is not uniform, as a result of which corrosion resistance is reduced and if painting is performed, the adherence of the aluminum-zinc plated steel sheet to a coating film formed by painting is reduced.

Therefore, conventionally, a surface treatment for improving corrosion resistance and blackening resistance is performed on the aluminum-zinc plated steel sheet. In the past, a chromate treatment, a treatment for forming a resin covering film including chromium, or the like has been performed. However, recently there is a demand not to use chromium from the point of view of environmental protection and the like, and thus an attempt has been made to use a surface treatment agent that does not contain chromium.

For example, JP 2003-201578 A (hereinafter, referred to as Document 1) discloses that a covering film is formed from a surface treatment agent containing an urethane resin, N-methylpyrrolidone, a zirconium metallic compound, and a silane coupling agent. JP S57-39314 B (hereinafter, referred to as Document 2) discloses that a protective coverage is formed from an acidic solution having a pH of 2 to 4 that contains at least one of Ti salts and Zr salts, and $H_2O_2$ and at least one of phosphoric acid, condensed phosphoric acids and derivatives of phosphoric acid. JP 3992173 B2 (hereinafter, referred to as Document 3) discloses that a treatment is performed on a metal surface using a non-chromate-type composition for metal surface treatment containing a metal acetylacetonate and at least one of a water-soluble inorganic titanium compound and a water-soluble inorganic zirconium compound in a specific ratio.

However, with the method described in Document 1, if alkaline cleaning is performed on the aluminum-zinc plated steel sheet before painting, the covering film is sometimes partially peeled off, resulting in unevenness in the appearance thereof after painting. The covering films formed by the methods described in Documents 2 and 3 contain a large amount of soluble salts such as phosphorus compounds and fluorine compounds. Therefore, the covering film is likely to elute soluble salts in a high temperature and high humidity atmosphere. Furthermore, these soluble salts are likely to be eluted therefrom in alkaline cleaning. Thus, the corrosion resistance and blackening resistance of the aluminum-zinc plated steel sheet are reduced.

SUMMARY OF INVENTION

The present invention has been made in view of the above-described issues, and an object thereof is to provide an aluminum-zinc plated steel sheet with high corrosion resistance and blackening resistance on which a surface treatment is performed using a surface treatment agent that does not contain chromium, and to inhibit these properties from decreasing due to adhesion of an alkaline solution or moisture.

The aluminum-zinc plated steel sheet according to the first aspect of the present invention includes a plated steel sheet, and a covering film that covers the plated steel sheet, the covering film containing:

a basic compound of transition metal other than cobalt and chromium; and metallic cobalt, or metallic cobalt and a cobalt compound, an amount of the covering film per one side of the plated steel sheet being within a range of 0.01 to 0.8 g/m$^2$, an amount in terms of mass of transition metal other than cobalt in the covering film per one side of the plated steel sheet being within a range of 4 to 400 mg/m$^2$, and an amount in terms of mass of cobalt in the covering film per one side of the plated steel sheet being within a range of 0.1 to 20 mg/m$^2$. If the covering film is formed only on a surface of the plated steel sheet, an amount of a covering film per one side of a plated steel sheet refers to mass of the covering film on the surface of the plated steel sheet per unit area, and if the covering film is formed on both a surface and a surface opposite to the surface, the amount of the covering film per one side of a plated steel sheet refers to mass of the covering film on each surface thereof per unit area. An amount in terms of mass of transition metal other than cobalt refers to mass of transition metal other than cobalt per in the covering film unit area derived from the total mass of transition metal atoms other than cobalt that are present in the covering film. The transition metal atoms can be present in a simple substance or in a compound. An amount in terms of mass of cobalt refers to mass of cobalt in the covering film per unit area derived from the total mass of cobalt atoms that are present in the covering film. The cobalt atoms may be present in a simple substance or in a compound.

Thus, the aluminum-zinc plated steel sheet according to the first aspect of the present invention has excellent corrosion resistance, blackening resistance, alkali-resistance, and condensation resistance. In the present description, alkali-resistance means an ability of a substance not to be affected by corrosion, blackening, and discoloration resulting from exposure to an alkaline solution, and condensation resistance means an ability of a substance not to be affected by corrosion, blackening, and discoloration resulting from adhesion of moisture. The aluminum-zinc plated steel sheet according to the first aspect of the present invention has also excellent heat discoloration resistance. Furthermore, in the case where painting is performed on the aluminum-zinc plated steel sheet according to the first aspect of the present invention, the aluminum-zinc plated steel sheet has high adherence to a coating film.

In the aluminum-zinc plated steel sheet according to the second aspect of the present invention realized in combination with the first aspect, the amount in terms of mass of cobalt in the covering film is greater than 0.5 $mg/m^2$ and not greater than 20 $mg/m^2$. In this case, the aluminum-zinc plated steel sheet has particularly excellent corrosion resistance and alkali-resistance.

In the aluminum-zinc plated steel sheet according to the third aspect of the present invention realized in combination with the first or second aspect, the plated steel sheet includes a plating layer containing zinc and aluminum, and a percentage of aluminum in the plating layer is within a range of 1% by mass to 75% by mass. In this case, the aluminum-zinc plated steel sheet has particularly excellent corrosion resistance and alkali-resistance.

In the aluminum-zinc plated steel sheet according to the fourth aspect of the present invention realized in combination with the third aspect, the plating layer contains magnesium, and a percentage of magnesium in the plating layer is greater than 0% by mass and not greater than 6.0% by mass. In this case, the aluminum-zinc plated steel sheet has particularly excellent corrosion resistance and alkali-resistance.

In the aluminum-zinc plated steel sheet according to the fifth aspect of the present invention realized in combination with the third or fourth aspect, the plating layer contains Si so that a percentage by mass of Si to aluminum in the plating layer is within a range of 0.1% to 10%. In this case, the aluminum-zinc plated steel sheet has particularly excellent corrosion resistance.

In the aluminum-zinc plated steel sheet according to the sixth aspect of the present invention realized in combination with any one of the third to fifth aspects, the plating layer contains at least one of: Ni in an amount of greater than 0% by mass and not greater than 1% by mass of the plating layer; and Cr in an amount of greater than 0% by mass and not greater than 1% by mass of the plating layer. In this case, the aluminum-zinc plated steel sheet has particularly excellent corrosion resistance.

In the aluminum-zinc plated steel sheet according to the seventh aspect of the present invention realized in combination with any one of the third to sixth aspects, the plating layer contains at least one of: Ca in an amount of greater than 0% by mass and not greater than 0.5% by mass of the plating layer; Sr in an amount of greater than 0% by mass and not greater than 0.5% by mass of the plating layer; Y in an amount of greater than 0% by mass and not greater than 0.5% by mass of the plating layer; La in an amount of greater than 0% by mass and not greater than 0.5% by mass of the plating layer; and Ce in an amount of greater than 0% by mass and not greater than 0.5% by mass of the plating layer. In this case, the aluminum-zinc plated steel sheet has particularly excellent corrosion resistance, and the occurrence of defects on the surface of the plated steel sheet is suppressed.

In the aluminum-zinc plated steel sheet according to the eighth aspect of the present invention realized in combination with any one of the first to seventh aspects, the transition metal in the basic compound includes zirconium. In this case, the aluminum-zinc plated steel sheet has particularly excellent corrosion resistance, blackening resistance, and alkali-resistance.

In the aluminum-zinc plated steel sheet according to the ninth aspect of the present invention realized in combination with any one of the first to eighth aspects, the transition metal in the basic compound is at least one selected from a group consisting of zirconium, vanadium, molybdenum, and niobium. It is also preferable that the transition metal in the basic compound includes zirconium and at least one selected from a group consisting of vanadium, molybdenum, and niobium. In this case, the aluminum-zinc plated steel sheet has particularly excellent corrosion resistance, blackening resistance, and alkali-resistance.

In the aluminum-zinc plated steel sheet according to the tenth aspect of the present invention realized in combination with any one of the first to ninth aspects, the covering film is formed through applying an aqueous surface regulator onto the plated steel sheet and drying the aqueous surface regulator on the plated steel sheet, the aqueous surface regulator having a pH of 7.5 to 10 and containing a basic compound (A) of transition metal other than cobalt and chromium, a cobalt compound (B), and water. In this case, it is possible to provide the aluminum-zinc plated steel sheet with particularly excellent corrosion resistance, blackening resistance, and alkali-resistance by a simplified treatment.

In the aluminum-zinc plated steel sheet according to the eleventh aspect of the present invention realized in combination with the tenth aspect, a peak metal temperature of the plated steel sheet in drying the aqueous surface regulator on the plated steel sheet is within a range of 40 to 200° C. In this case, the aluminum-zinc plated steel sheet has particularly excellent corrosion resistance and blackening resistance.

The method for producing an aluminum-zinc plated steel sheet according to the twelfth aspect of the present invention includes a step of forming a covering film through applying an aqueous surface regulator onto a plated steel sheet and drying the aqueous surface regulator on the plated steel sheet, the aqueous surface regulator having a pH of 7.5 to 10 and containing a basic compound (A) of transition metal other than cobalt and chromium, a cobalt compound (B), and water.

Thus, it is possible to provide the aluminum-zinc plated steel sheet with excellent corrosion resistance, blackening resistance, and alkali-resistance by a simplified treatment. Furthermore, it is possible to provide the aluminum-zinc plated steel sheet with excellent heat discoloration resistance, and also high adherence to a coating film formed by painting the aluminum-zinc plated steel sheet.

Moreover, the aluminum-zinc plated steel sheet with excellent properties can be provided by a simplified treatment without performing multiple complex treatments, and therefore it is also possible to reduce manufacturing cost and down size manufacturing lines.

In the method for producing an aluminum-zinc plated steel sheet according to the thirteenth aspect of the present invention realized in combination with the twelfth aspect, a peak metal temperature of the plated steel sheet in drying the aqueous surface regulator on the plated steel sheet is within a range of 40 to 200° C. In this case, it is possible to provide the aluminum-zinc plated steel sheet with particularly excellent alkali-resistance.

In the method for producing an aluminum-zinc plated steel sheet according to the fourteenth aspect of the present invention realized in combination with the twelfth or thirteenth aspect, a mass ratio of an amount of atoms of cobalt contained in the cobalt compound (B) to a total amount of the basic compound (A) is within a range of 1/10 to 1/1000. In this case, it is possible to provide the aluminum-zinc plated steel sheet with particularly excellent condensation resistance.

DESCRIPTION OF EMBODIMENTS

Figure 1:
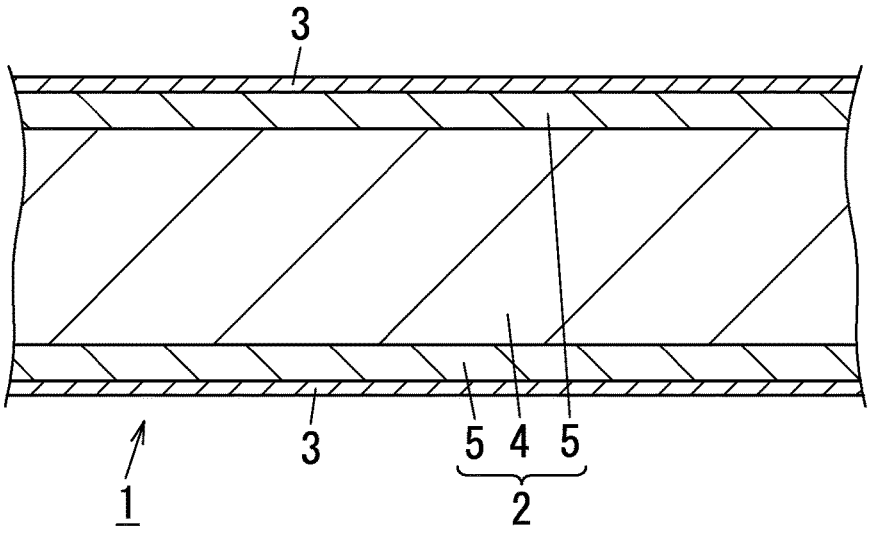
FIG. 1 is a cross-sectional view showing an aluminum-zinc plated steel sheet according to an embodiment of the present invention.

One embodiment of the present invention will now be described hereinafter. FIG. 1 shows an aluminum-zinc plated steel sheet 1 according to the present embodiment.

An aluminum-zinc plated steel sheet 1 according to the present embodiment includes a plated steel sheet 2 and a covering film 3 that covers this plated steel sheet 2. The covering film 3 is made from an aqueous surface regulator. Furthermore, the aluminum-zinc plated steel sheet 1 may include one or more layers which are on the covering film 3 and different from the covering film 3. Examples of the layers different from the covering film 3 include a composite covering film containing resin or the like.

The plated steel sheet 2 includes a steel sheet 4 and a plating layer 5 that covers this steel sheet 4. The plating layer 5 is formed through known means, such as immersion of the steel sheet 4 in a molten metal bath or the like.

It is preferable that the plating layer 5 contains zinc and aluminum as constituent elements. It is also preferable that the plating layer 5 further contains magnesium. If the plating layer 5 contains zinc and aluminum, the surface of the plating layer 5 is covered with a thin aluminum oxide covering film. This oxide covering film offers a protective effect, which particularly leads to improvement of corrosion resistance of the surface of the plating layer 5. Furthermore, zinc may cause a sacrificial corrosion-preventive effect, which leads to suppression of edge creep at an end face of the aluminum-zinc plated steel sheet 1. Thus, the aluminum-zinc plated steel sheet 1 has particularly high corrosion resistance. If the plating layer 5 further contains magnesium that is a less noble metal than zinc, the protective effect caused by aluminum and the sacrificial corrosion-preventive effect caused by zinc derived from the plating layer 5 are both enhanced, and thus the corrosion resistance of the aluminum-zinc plated steel sheet 1 is further improved.

It is preferable that a percentage of aluminum in the plating layer 5 is within a range of 1 to 75% by mass. It is more preferable that this percentage is not less than 5% by mass. It is also preferable that the percentage is not greater than 65% by mass, and it is further preferable that the percentage is not greater than 15% by mass. If the percentage of aluminum is not less than 5% by mass, aluminum is first solidified in forming the plating layer 5, and therefore a protective effect by the aluminum oxide covering film is easily exhibited. If the percentage of aluminum is within a range of 45 to 65% by mass, in the plated steel sheet 5 a protective effect by aluminum is mainly exhibited, and in addition to this, the sacrificial corrosion-preventive effect by zinc is also exhibited, and thus the corrosion resistance of the aluminum-zinc plated steel sheet 1 is particularly improved. Furthermore, if the percentage of aluminum is within a range of 5 to 15% by mass, in the plating layer 5 the sacrificial corrosion-preventive effect by zinc is mainly exhibited, and in addition to this, the protective effect by aluminum is also exhibited, and thus the corrosion resistance of the aluminum-zinc plated steel sheet 1 is particularly improved.

It is preferable that a percentage of magnesium in the plating layer 5 is greater than 0% by mass and not greater than 6.0% by mass. In particular, if this percentage of magnesium therein is not less than 0.1% by mass, effects resulting from the addition of magnesium is clearly exhibited. It is more preferable that the percentage thereof is within a range of 1.0 to 5.0% by mass, because an effect of improving the corrosion resistance is successfully achieved.

The plating layer 5 may contain at least one selected from Si, Ni, Ce, Cr, Fe, Ca, Sr, and rare earth elements as constituent elements.

In the case where the plating layer 5 contains at least one selected from Ni, Cr; alkaline earth metal elements such as Ca and Sr; and rare earth elements such as Y, La, and Ce, the protective effect by aluminum in the plating layer 5 and the sacrificial corrosion-preventive effect by zinc are both enhanced, and thus the corrosion resistance of the aluminum-zinc plated steel sheet 1 is further improved.

In particular, it is preferable that the plating layer 5 contains at least one of Ni and Cr. In the case where the plating layer 5 contains Ni, a percentage of Ni in the plating layer 5 is preferably greater than 0% by mass and not greater than 1% by mass. It is further preferable that this percentage is within a range of 0.01 to 0.5% by mass. In the case where the plating layer 5 contains Cr, a percentage of Cr in the plating layer 5 is preferably greater than 0% by mass and not greater than 1% by mass. It is further preferable that this percentage is within a range of 0.01 to 0.5% by mass. In these cases, the corrosion resistance of the aluminum-zinc plated steel sheet 1 is particularly improved. In order to improve the corrosion resistance, it is preferable that Ni and Cr are present near the interface between the steel sheet 4 and the plating layer 5, and alternatively Ni and Cr in the plating layer 5 each have an uneven concentration distribution such that the concentration becomes greater towards the steel sheet 4.

It is also preferable that the plating layer 5 contains at least one of Ca, Sr, Y, La, and Ce. In the case where the plating layer 5 contains Ca, a percentage of Ca in the plating layer 5 is preferably greater than 0% and not greater than 0.5% by mass. It is further preferable that this percentage is within a range of 0.001 to 0.1% by mass. In the case where the plating layer 5 contains Sr, a percentage of Sr in the plating layer 5 is preferably greater than 0% and not greater than 0.5% by mass. It is further preferable that this percentage is within a range of 0.001 to 0.1% by mass. In the case where the plating layer 5 contains Y, a percentage of Y in the plating layer 5 is preferably greater than 0% and not greater than 0.5% by mass. It is further preferable that this percentage is within a range of 0.001 to 0.1% by mass. In the case where the plating layer 5 contains La, a percentage of La in the plating layer 5 is preferably greater than 0% and not greater than 0.5% by mass. It is further preferable that this percentage is within a range of 0.001 to 0.1% by mass. In the case where the plating layer 5 contains Ce, a percentage of Ce in the plating layer 5 is preferably greater than 0% and not greater than 0.5% by mass. It is further preferable that this percentage is within a range of 0.001 to 0.1% by mass. In these cases, the corrosion resistance of the aluminum-zinc plated steel sheet 1 is particularly improved, and an effect of suppressing defects on the surface of the plating layer 5 is expected to be achieved.

In the case where the plating layer 5 contains Si, the aluminum-zinc plated steel sheet 1 has improved mechanical processability. This is because Si suppresses growth of an alloy layer in the interface between the plating layer 5 and the steel sheet 4, and thus appropriate adherence between the plating layer 5 and the steel sheet 4 can be maintained and processability is improved. Furthermore, it is expected that Si forms an alloy together with magnesium and this leads to further improvement of the corrosion resistance of the aluminum-zinc plated steel sheet 1. In the case where the plating layer 5 contains Si, a percentage by mass of Si to Al in the plating layer 5 is preferably within a range of 0.1 to 10%. In this case, the mechanical processability of the aluminum-zinc plated steel sheet 1 and the corrosion resistance of part of the aluminum-zinc plated steel sheet 1 resulting from mechanical processing are further improved. It is further preferable that the percentage by mass of Si to Al therein is within a range of 1 to 5%.

The plating layer 5 may contain one or more elements other than zinc, aluminum, magnesium, Si, Ni, Ce, Cr, Fe, Ca, Sr, and rare earth elements. For example, the plating layer 5 may contain at least one selected from the group consisting of Pb, Sn, Co, B, Mn, and Cu. The one or more elements other than zinc, aluminum, magnesium, Si, Ni, Ce, Cr, Fe, Ca, Sr, and rare earth elements may be contained in the plating layer 5 as constituent elements, and be inevitably mixed in the plating layer 5 due to being eluted from the steel sheet 4 or being present as impurities in a raw material in a plating bath. It is preferable that a percentage of a total amount of the one or more elements other than zinc, aluminium, magnesium, Si, Ni, Ce, Cr, Fe, Ca, Sr, and rare earth elements in the plating layer 5 is not greater than 0.1% by mass.

In the case of obtaining the plated steel sheet 2 through plating the steel sheet 4, in order to improve plating wettability, plating adherence of the steel sheet 4, and the like, alkaline degreasing or pickling may be performed on the steel sheet 4 before the steel sheet 4 is immersed in a molten metal bath, and alternatively a flux treatment may be performed using zinc chloride, ammonium chloride, or another chemical agent. Examples of another method for plating the steel sheet 4 include a method of preheating the steel sheet 4 in a non-oxidizing furnace and then subjecting the steel sheet 4 to reduction annealing in a reducing furnace and subsequently immersing the steel sheet 4 in the molten metal bath and then taking out the steel sheet 4 from the bath. Moreover, examples of a method for plating the steel sheet 4 include a method of using a full-reducing furnace. In any method described above, molten metal is made adhere to the steel sheet 4, the amount of adhering molten metal is adjusted by a gas wiping method, and then the steel sheet 4 with the molten metal is cooled to obtain the plated steel sheet 2. These processes can be sequentially performed.

In preparing the molten metal bath, an alloy may be prepared in advance to have a composition suitable for the plated steel sheet 2 used in the present embodiment and then be heated and melted, or a combination of one or more single metal and/or one or more alloys of more than two types of metal may be heated and melted to prepare the molten metal bath having a predetermined composition. In order to heat and melt metal, metal may be directly melted in a plating pot, and alternatively metal may be melted in a preliminary melting furnace in advance and then transferred to a plating pot. In the case where the preliminary melting furnace is used, the cost of installing the equipment is increased, but there are advantages in that impurities such as dross resulting from melting metal can be easily removed and the temperature of the molten metal bath can be easily maintained.

To clean the plated steel sheet 2 by removing oil and unwanted substances, the plated steel sheet 2 may be washed with a washing agent before formation of the covering film 3. Examples of the washing agent include known washing agents produced by mixing inorganic components such as acidic components or alkaline components, a chelating agent, a surfactant, and the like. The pH of the washing agent can be any value, that is, the washing agent may be either alkaline or acidic as long as the capability of the aluminum-zinc plated steel sheet 1 is not degraded.

The aqueous surface regulator used for forming the covering film 3 on the plated steel sheet 2 and the covering film 3 made from the aqueous surface regulator will be described.

The aqueous surface regulator and the covering film 3 made from this aqueous surface regulator do not contain metallic chromium or a chromium compound. This means that the metallic chromium or a chromium compound is not added to the aqueous surface regulator and the covering film 3, except when they are inevitably mixed therein.

The aqueous surface regulator has a pH of 7.5 to 10 and contains a basic compound (A) of transition metal other than cobalt and chromium, a cobalt compound (B), and water. The covering film 3 made from such an aqueous surface regulator contains a basic compound of transition metal other than cobalt and chromium, and metallic cobalt, or metallic cobalt and a cobalt compound.

For example, the aqueous surface regulator has a pH of 7.5 to 10 and contains a basic compound (A), a cobalt compound (B), and water. The covering film 3 made from such an aqueous surface regulator contains a basic zirconium compound, and metallic cobalt, or metallic cobalt and a cobalt compound, for example.

The aqueous surface regulator is alkaline, that is, has a pH of 7.5 to 10, and thus has an advantage in processing. If the aqueous surface regulator is acidic, the components of the plating layer 5 are likely to be eluted therefrom, and thus the original properties of the plating layer 5 cannot be exhibited to the maximum extent. Furthermore, if the covering film 3 is made from an acidic aqueous surface regulator, soluble salts are likely to be present in the covering film 3, resulting in reduced alkali-resistance and condensation resistance of the aluminum-zinc plated steel sheet 1 as well as reduced corrosion resistance and blackening resistance thereof.

In the case where the plating layer 5 contains magnesium, the aqueous surface regulator is preferably alkaline rather than acidic. If the aqueous surface regulator is acidic, magnesium is likely to be eluted from the plating layer 5. In contrast, if the aqueous surface regulator is alkaline, magnesium is unlikely to elute from the plating layer 5, and thus the surface of the plating layer 5 is unlikely to be damaged. Accordingly, it is possible to make use of the properties of the plating layer 5 and synergistically exhibit the properties of the covering film 3.

Furthermore, if the pH of the aqueous surface regulator is within a range of 7.5 to 10, storage stability and solution stability during treatments of the aqueous surface regulator are high.

The pH of the aqueous surface regulator is more preferably greater than 8, and is further preferably 8.5 or greater. This pH is also preferably 10 or less, and further preferably 9.5 or less. This pH is also preferably within a range of 8 to 10, and is further preferably within a range of 8.5 to 9.5.

In order to adjust the pH of the aqueous surface regulator, known acidic components such as sulfuric acid, hydrochloric acid, and nitric acid, known basic components such as ammonia, amines, and sodium hydroxide, and the like can be mixed in the aqueous surface regulator, for example.

The transition metal in the basic compound (A) can include zirconium, vanadium, molybdenum, niobium, titanium, and the like. The basic compound (A) of the transition metal can include ammonium salts, carbonates, chlorides, ammonium carbonate, alkali metal carbonates, amine salts, diethanolamine salts, and the like.

It is preferable that the transition metal in the basic compound (A) includes zirconium. In other words, it is preferable that the basic compound (A) includes a basic zirconium compound. The basic compound (A) may include a basic zirconium compound only, and alternatively may include a basic compound of transition metal other than zirconium as well as a basic zirconium compound.

As described above, the transition metal may include titanium. However, when the transition metal does not include titanium, the aluminum-zinc plated steel sheet 1 has increased corrosion resistance, blackening resistance, and condensation resistance. Therefore, it is more preferable that the transition metal does not include titanium. It is conceivable that one reason is that a basic titanium compound has high affinity for water, and thus if the basic titanium compound is present in the covering film 3, condensation is likely to occur. It is also conceivable that another reason is that high reactivity of the basic titanium compound and the cobalt compound inhibits generation of metallic cobalt in the covering film 3, which will be described in detail later.

It is also preferable that the transition metal in the basic compound (A) is at least one selected from the group consisting of zirconium, vanadium, molybdenum, and niobium. For example, it is preferable that the basic compound (A) is one selected from the group consisting of basic zirconium compounds, basic vanadium compounds, basic molybdenum compounds, and basic niobium compounds. In this case, it is also preferable that zirconium is an essential component, that is, the transition metal in the basic compound (A) is zirconium and at least one selected from the group consisting of vanadium, molybdenum, and niobium.

The basic zirconium compound can include at least one selected from basic zirconium, basic zirconyl, basic zirconyl salts, basic zirconium carbonate, basic zirconyl carbonate, basic zirconium carbonate salts, and basic zirconyl carbonate salts. Examples of the type of salts include ammonium salts, salts of alkali metals such as sodium, potassium, and lithium, amine salts, and diethanolamine salts. More specifically, the basic zirconium compound can include at least one selected from ammonium zirconyl carbonate $[(NH_4)_2ZrO(CO_3)_2]$, potassium zirconyl carbonate $[K_2ZrO(CO_3)_2]$, sodium zirconyl carbonate $[Na_2Zr(CO_3)_2]$, ammonium zirconium carbonate $\{(NH_4)_2[Zr(CO_3)_2(OH)_2\}$, potassium zirconium carbonate $\{K_2[Zr(CO_3)_2(OH)_2\}$, and sodium zirconium carbonate $\{Na_2[Zr(CO_3)_2(OH)_2\}$. In particular, it is preferable that the basic zirconium compound includes at least one of ammonium zirconyl carbonate $[(NH_4)_2ZrO(CO_3)_2]$ and ammonium zirconium carbonate $\{(NH_4)_2[Zr(CO_3)_2(OH)_2\}$.

Examples of the basic vanadium compound include vanadium (III) chloride, vanadium (IV) chloride, ammonium metavanadate, sodium metavanadate, and $PbZn(VO_4)(OH)$.

Examples of the basic molybdenum compound include ammonium molybdate, sodium molybdate, molybdeum (V) chloride, molybdeum (III) chloride, $MoO_2(OH)_2$, and $MoO(OH)_4$.

Examples of the basic niobium compound include niobium (V) chloride and sodium niobate.

It is preferable that the cobalt compound (B) includes at least one selected from the group consisting of cobalt sulfates, cobalt chlorides, cobalt carbonates, cobalt phosphates, cobalt acetates, and cobalt nitrates. Examples of such cobalt salts include cobalt (II) nitrate, cobalt (II) sulfate, cobalt (II) chloride, cobalt (II) carbonate, and cobalt (II) phosphate. The cobalt compound (B) may include cobalt acetylacetonate, cobalt ethylenediaminetetraacetate, cobalt (II) acetate, cobalt (II) oxalate, cobalt (III) oxalate, cobalt (III) oxide, cobalt (IV) oxide, and the like. The cobalt compound (B) can include at least one selected from these compounds.

In particular, it is preferable that the cobalt compound (B) includes at least one selected from cobalt sulfates, cobalt chlorides, and cobalt nitrates. In other words, it is preferable that the cobalt compound (B) includes at least one of cobalt (II) nitrate, cobalt (II) sulfate, and cobalt (II) chloride. It is further preferable that the cobalt compound (B) includes cobalt (II) nitrate.

The aqueous surface regulator can be prepared through mixing the basic compound (A), the cobalt compound (B), and water, and then mixing at least one of an acidic component and a basic component for adjusting the pH as necessary into the mixture. The amount of the basic compound (A) and the amount of the cobalt compound (B) in the aqueous surface regulator are appropriately adjusted in accordance with the coating property of the aqueous surface regulator, transition metal-containing amount, a cobalt-containing amount, and the like that are desired for the coating film 3.

It is preferable that the mass ratio of an amount of atoms of cobalt contained in the cobalt compound (B) to the total amount of the basic compound (A) (mass of cobalt atoms contained in the cobalt compound (B)/mass of the basic compound (A)) is within a range of $1/10$ to $1/1000$. The above is preferable in that the effect of condensation resistance is achieved in this range. This ratio is more preferably $1/25$ or less, and further preferably $1/60$ or less. This ratio is also preferably $1/500$ or greater, and further preferably $1/200$ or greater. This ratio is also preferably within a range of $1/25$ to $1/500$, and further preferably within a range of $1/60$ to $1/200$.

It is preferable that the ratio of a phosphorus compound and a fluorine compound in the aqueous surface regulator is small, or that the aqueous surface regulator does not contain a phosphorus compound or a fluorine compound. In other words, it is preferable that the ratio of a phosphorus compound and a fluorine compound in the covering film 3 made of the aqueous surface regulator is small, or that the covering film 3 does not contain a phosphorus compound or fluorine compound. Since the phosphorus compound and the fluorine compound are likely to elute therefrom into an alkaline solution, if the covering film 3 includes excessive amounts of the phosphorus compound and the fluorine compound, there is a risk in that the aluminum-zinc plated steel sheet 1 loses alkali-resistance.

If the ratio of the fluorine compound in the aqueous surface regulator is small or the aqueous surface regulator does not include the fluorine compound, there is also an advantage in that the aluminum-zinc plated steel sheet 1 particularly has improved blackening resistance. It is conceivable that this is because the fluorine compound has high reactivity with the cobalt compound, resulting in the inhibition of generation of metallic cobalt in the covering film 3. This will be described in detail later.

In particular, the percentage of the total amount of the phosphorus compound and the fluorine compound in the covering film 3 is preferably 1% by mass or less, and further preferably 0.1% by mass or less.

It is also preferable that the aqueous surface regulator does not include a substance having a strong oxidizing ability, such as hydrogen peroxide water. In this case, the corrosion resistance and the blackening resistance of the aluminum-zinc plated steel sheet are particularly improved. It is conceivable that this is because a substance having a strong oxidizing ability inhibits generation of metallic cobalt in the covering film 3.

The covering film 3 is formed as a result of applying the aqueous surface regulator onto the plating layer 5. Specific examples therefor include a reaction-type treatment and a coating-type treatment, and any method may be adopted. In the reaction-type treatment, the covering film 3 can be formed through making the aqueous surface regulator come into contact with the plating layer 5 using a shower Ringer method, for example. It is preferable that the temperature of the aqueous surface regulator when the aqueous surface regulator is applied onto the plating layer 5 in this case is within a range of 10 to 80° C. In the coating-type treatment, after the aqueous surface regulator comes into contact with the plating layer 5 using a roll coating method, a spraying method, an immersion method, an air-knife method, or a curtain flow method, for example, the aqueous surface regulator is dried without washing off the aqueous surface regulator, as a result of which the covering film 3 can be formed. The temperature of the aqueous surface regulator applied onto the plating layer 5 in this case is preferably within a range of 10 to 60° C., and more preferably within a range of 30 to 40° C. In order to increase the effects of one embodiment of the present invention through increasing the amount of the covering film 3, the coating-type treatment is preferably adopted.

In the case where the coating-type treatment is adopted, it is preferable that the aqueous surface regulator is applied onto the plating layer 5 of the plated steel sheet 2 and then is heated and dried using a heater to form the covering film 3. It is preferable that the temperature (peak metal temperature) of the plated steel sheet 2 in heating and drying the aqueous surface regulator on the plated steel sheet is within a range of 40 to 200° C. If the peak metal temperature is 40° C. or greater, the aqueous surface regulator is efficiently dried, and thus formation efficiency of the covering film 3 is good. If the peak metal temperature is 200° C. or less, the aluminum-zinc plated steel sheet 1 has particularly high corrosion resistance and blackening resistance. It is conceivable that this is because if the peak metal temperature is higher than 200° C., the aqueous surface regulator is dried excessively quickly, resulting in the inhibition of generation of metallic cobalt, whereas if the peak metal temperature is 200° C. or less, generation of metallic cobalt is unlikely to be inhibited in the process in which the aqueous surface regulator is dried.

The aluminum-zinc plated steel sheet 1 can be obtained through providing the covering film 3 on the plated steel sheet 2 in this manner.

It is preferable that the amount of the covering film 3 per one side of the plated steel sheet 2 is within a range of 0.01 to 0.8 g/m$^2$. If this amount is 0.01 g/m$^2$ or greater, effects of improving the blackening resistance and corrosion resistance resulting from the covering film 3 are significantly exhibited. If the amount is 0.8 g/m$^2$ or less, effects of improving the blackening resistance and corrosion resistance are significantly exhibited due to the covering film 3 being densified in particular. The amount is more preferably 0.03 g/m$^2$ or greater, and further preferably 0.05 g/m$^2$ or greater. The amount is also preferably 0.6 g/m$^2$ or less. This amount is also preferably within a range of 0.03 to 0.6 g/m$^2$, and particularly preferably within a range of 0.05 to 0.6 g/m$^2$.

The covering film 3 of the aluminum-zinc plated steel sheet 1 contains: a basic compound of transition metal other than cobalt and chromium; and metallic cobalt, or metallic cobalt and a cobalt compound.

The basic compound of transition metal other than cobalt and chromium in the covering film 3 comes from the basic compound (A) in the aqueous surface regulator. The basic compound in the covering film 3 may not be completely same as the basic compound (A) as long as the basic compound is a compound of transition metal having a basic property. Even if a portion or whole of the basic compound (A) is transformed into another compound in the covering film 3 through a chemical reaction, it is sufficient that the basic compound of transition metal is present in the covering film 3. For example, in the case where a portion or whole of the basic compound (A) that does not include hydroxides and basic oxides of transition metal changes to hydroxides or basic oxides of the transition metal in the covering film 3, the hydroxides and basic oxides of transition metal are included in the basic compound in the covering film 3. It is also acceptable that the basic compound in the covering film 3 further includes a substance that does not come from the basic compound (A).

Similarly to the transition metal in the basic compound (A), the transition metal in the basic compound in the covering film 3 can include zirconium, vanadium, molybdenum, niobium, titanium, and the like, for example. The basic compound in the covering film 3 can include hydroxides, basic oxides, ammonium salts, carbonates, chlorides, ammonium carbonates, alkali metal carbonates, amine salts, diethanolamine salts of transition metal, for example.

It is preferable that the transition metal in the basic compound in the covering film 3 includes zirconium. In other words, it is preferable that the basic compound includes a basic zirconium compound. The basic compound may include only a basic zirconium compound, and alternatively may contain a basic compound of transition metal other than zirconium as well as a basic zirconium compound.

It is also preferable that the transition metal in the basic compound in the covering film 3 is at least one selected from the group consisting of zirconium, vanadium, molybdenum, and niobium. For example, it is preferable that the basic compound is one selected from the group consisting of basic zirconium compounds, basic vanadium compounds, basic molybdenum compounds, and basic niobium compounds. It is also preferable that zirconium is an essential component, that is, the transition metal in the basic compound is zirconium and at least one selected from the group consisting of vanadium, molybdenum, and niobium.

The metallic cobalt, or the metallic cobalt and the cobalt compound in the covering film 3 come from the cobalt compound (B) in the aqueous surface regulator. In other words, as a result of the metallic cobalt being produced from a portion or whole of the cobalt compound (B) in the process in which the covering film 3 is made from the aqueous surface regulator, the covering film 3 includes the metallic cobalt. It is conceivable that the reason why the metallic cobalt is produced is that a substitution reaction occurs between the cobalt compound in the aqueous surface regulator and zinc or aluminum in the plating layer 5 when the aqueous surface regulator according to the present embodiment comes into contact with the plating layer 5. Alternatively, it is also conceivable that the concentrations of Zn ions and Al ions in the aqueous surface regulator are increased due to a substitution reaction between a metal ion coming from the basic transition metal compound (A) in the aqueous surface regulator and metal in the plating layer 5, and thus Co having a relatively lower ionization tendency is deposited as metal. It is also conceivable that the above-described two reactions occur together. In the case where the covering film 3 includes the cobalt compound, the cobalt compound may not completely same as the cobalt compound (B). For example, in the case where a portion of the cobalt compound (B) changes into another compound due to a chemical reaction in the process in which the covering film 3 is formed, this compound is included in the cobalt compound in the covering film 3. It is also acceptable that the metallic cobalt, or the metallic cobalt and the cobalt compound in the covering film 3 include a substance that does not come from the cobalt compound (B).

The amount in terms of mass of transition metal in the covering film 3 per one side of the plated steel sheet 2 is preferably within a range of 4 to 400 $mg/m^2$, and further preferably within a range of 5 to 400 $mg/m^2$. In this case, effects of improving the blackening resistance and the corrosion resistance are significantly exhibited. The amount in terms of mass of transition metal is more preferably 8 $mg/m^2$ or greater, and further preferably 15 $mg/m^2$ or greater. This amount is also preferably 200 $mg/m^2$ or less, and further preferably 100 $mg/m^2$ or less. This amount is also preferably within a range of 8 to 200 $mg/m^2$, and particularly preferably within a range of 15 to 100 $mg/m^2$.

In the case where the transition metal in the basic compound in the covering film 3 includes zirconium, the amount in terms of mass of Zr in the covering film 3 per one side of the plated steel sheet 2 is preferably within a range of 4 to 400 $mg/m^2$, and further preferably within a range of 5 to 400 $mg/m^2$. In this case, effects of improving the blackening resistance and the corrosion resistance are significantly exhibited. The amount in terms of mass of Zr is more preferably 8 $mg/m^2$ or greater, and further preferably 15 $mg/m^2$ or greater. This amount is also preferably 200 $mg/m^2$ or less, and further preferably 100 $mg/m^2$ or less. This amount is also preferably within a range of 8 to 200 $mg/m^2$, and particularly preferably within a range of 15 to 100 $mg/m^2$.

The amount in terms of mass of cobalt in the covering film 3 per one side of the plated steel sheet 2 is within a range of 0.1 to 20 $mg/m^2$. In this case, effects of improving the blackening resistance and the corrosion resistance are significantly exhibited. The amount in terms of mass of cobalt is more preferably 1 $mg/m^2$ or greater, and particularly preferably 1.5 $mg/m^2$ or greater. This amount in terms of mass of cobalt is also preferably 15 $mg/m^2$ or less, and particularly preferably 8 $mg/m^2$ or less. This amount in terms of mass of cobalt is also preferably within a range of 1 to 15 $mg/m^2$, and particularly preferably within a range of 1.5 to 8 $mg/m^2$.

When the covering film 3 is formed from the aqueous surface regulator, the covering film 3 including metallic cobalt, or metallic cobalt and a cobalt compound is formed on the plated steel sheet 2. Accordingly, the blackening resistance of the aluminum-zinc plated steel sheet 1 is further maintained for a longer period. Although blackening of the plating layer 5 occurs due to generation of non-stoichiometric oxides or hydroxides of zinc or aluminum in the plating layer 5, generation of such non-stoichiometric oxides or hydroxides is suppressed in the present embodiment. It is conceivable that this is because the metallic cobalt in the covering film 3 promotes generation of a stable and densified oxide film on the surface of the plating layer 5, resulting in the suppression of generation of non-stoichiometric oxides or hydroxides. Although it is conceivable that a stable compound of cobalt also functions, similarly to metallic cobalt, it is conceivable that the metallic cobalt more effectively functions.

As a result of the covering film 3 further including the basic compound of the transition metal, the corrosion resistance as well as the blackening resistance is further maintained for a long period. It is conjectured that this is because the covering film 3 contains the basic compound, resulting in the formation of a densified barrier film including a basic compound such as hydroxides coming from the basic compound (A) as a main component on the covering film 3.

Furthermore, in the present embodiment, the metallic cobalt and the basic compound are evenly distributed in the covering film 3 made from the aqueous surface regulator. In particular, in the case where the aqueous surface regulator and the covering film 3 do not contain a titanium compound or a fluorine compound, the metallic cobalt and the basic compound are likely to be more evenly distributed in the covering film 3. It is conceivable that this is because the titanium compound and the fluorine compound have high reactivity with the cobalt compound, resulting in, when the fluorine compound or the titanium compound is not present, the promotion of generation of metallic cobalt due to the substitution reaction between the cobalt compound and zinc and aluminum of the plating layer 5. As described above, it is thus preferable that the aqueous surface regulator and the covering film 3 do not contain the titanium compound or the fluorine compound. If the metallic cobalt and the basic compound are evenly distributed in the covering film 3, even if the aluminum-zinc plated steel sheet 1 is exposed to an atmosphere where blackening is likely to occur in a usual state, for example, an atmosphere of high temperature and high humidity, the metallic cobalt and the basic compound are not consumed in a short time period. Thus, the blackening resistance of the aluminum-zinc plated steel sheet 1 is maintained for a long time period as well as for a temporary storage time period until painting is performed. In the case where a layer different from this covering film 3 is formed on the covering film 3, that is, a composite covering film including a resin and the like is provided thereon, for example, blackening resistance is maintained for a longer time period.

Furthermore, the basic compound of transition metal and metallic cobalt, which are active components for corrosion resistance and blackening resistance in the covering film 3 are unlikely to elute therefrom into an alkaline solution. Therefore, the aluminum-zinc plated steel sheet 1 has high alkali-resistance.

As described above, the aluminum-zinc plated steel sheet 1 according to the present embodiment can be further provided with one or more layers different from the covering film 3 (for example, a composite covering film including a resin and the like) on the covering film 3. Therefore, the aluminum-zinc plated steel sheet 1 according to the present embodiment can be used as a steel sheet for a coating treatment (surface-adjusted aluminum-zinc plated steel sheet for a coating treatment).

The covering film 3 of the aluminum-zinc plated steel sheet 1 according to the present embodiment does not contain metallic chromium or a chromium compound, and also the aluminum-zinc plated steel sheet 1 has excellent corrosion resistance, blackening resistance, condensation resistance, alkali-resistance, heat discoloration resistance, and coating film adherence. Therefore, the aluminum-zinc plated steel sheet 1 can be used in various areas, such as building material products, home appliances, automobile members, and the like, and in particular can be applicable to building material products used outdoors.

EXAMPLE

Hereinafter, examples according to the present invention are specifically described, but the present invention is not limited to these examples. Note that the unit "part" described hereinafter all refers to "part by mass", unless otherwise stated.

[Plated Steel Sheet]

(1) Sample Material

SPCC (JIS G3141) having a thickness of 0.8 mm was heated and reduced using a Hot Dipping Process Simulator available from Rhesca Co., LTD. at 800° C. for 60 seconds in N2-H2 atmosphere, and then cooled to the temperature of the molten metal bath to produce an alloy plated steel material (plated steel sheet) having a plating composition shown in Table 1. A plating amount was set to 60 g/m$^2$ for one side.

The numerical values shown in Table 1 indicate content (% by mass) of elements in a plating layer. However, in Table 1, "Si/Al" indicates a percentage (%) by mass of Si to the total mass of Al in the plating layer. In Table 1, "remain" is written for "Zn and impurities". This means that remaining part, which does not include Mg, Si, Ni, Cr, Ca, Sr, Y, La, and Ce, of all of the constituent elements of the plating layer is occupied by Zn and inevitable impurities.

TABLE 1

| | Element content (mass %) of plating layer | | | | | | | | | | | | |
|---|---|---|---|---|---|---|---|---|---|---|---|---|---|
| No. | Al | Mg | Si | Si/Al | Fe | Ni | Cr | Ca | Sr | Y | La | Ce | Zn and impurities |
| 1 | 55 | — | 1.6 | 2.91 | 2.5 | — | — | — | — | — | — | — | remain |
| 2 | 5 | 0.1 | — | — | 0.2 | — | — | — | — | — | — | — | remain |
| 3 | 11 | 3 | 0.2 | 1.82 | 0.5 | — | — | — | — | — | — | — | remain |
| 4 | 55 | 2 | 1.6 | 2.91 | 2.5 | — | — | — | — | — | — | — | remain |
| 5 | 55 | 2 | 1.6 | 2.91 | 2.5 | — | 0.1 | 0.02 | — | — | — | — | remain |
| 6 | 55 | 2 | 1.6 | 2.91 | 2.5 | — | 0.1 | 0.02 | 0.002 | — | — | — | remain |
| 7 | 11 | 3 | 0.2 | 1.82 | 0.1 | 0.3 | — | — | — | — | — | — | remain |
| 8 | 6 | 3 | — | — | 0.2 | — | — | — | — | — | — | — | remain |
| 9 | 15 | 3 | 0.2 | 1.33 | 0.6 | — | — | — | — | — | — | — | remain |
| 10 | 60 | 1 | 1.6 | 2.67 | 2.7 | — | — | — | — | — | — | — | remain |
| 11 | 65 | 5 | 1.6 | 2.46 | 2.8 | — | 0.2 | 0.1 | — | — | — | — | remain |
| 12 | 50 | 4.5 | 2 | 4.00 | 2.3 | — | 0.05 | 0.08 | 0.002 | — | — | — | remain |
| 13 | 45 | 1.5 | 1.8 | 4.00 | 2.1 | — | 0.03 | — | — | 0.002 | — | — | remain |
| 14 | 13 | 3 | 0.15 | 1.15 | 0.8 | — | — | — | — | — | 0.05 | — | remain |
| 15 | 58 | 2 | 2.5 | 4.31 | 2.6 | 0.5 | — | — | — | — | — | 0.08 | remain |
| 16 | 3.5 | 3 | — | — | 0.1 | — | — | — | — | — | — | — | remain |
| 17 | 70 | — | 0.5 | 0.71 | 3.0 | 1 | — | — | — | — | 0.5 | — | remain |
| 18 | 55 | 6 | 3 | 5.45 | 2.5 | — | 0.001 | 0.3 | — | — | — | — | remain |
| 19 | 40 | — | 3 | 7.50 | 2.0 | — | — | — | — | 0.0005 | — | — | remain |
| 20 | 0.8 | — | — | — | 0.7 | — | — | — | — | — | — | — | remain |

(2) Degreasing Treatment

The surface of the plated steel sheet was cleaned through performing alkaline degreasing on the surface of the plated steel sheet produced in line with the preceding method. When alkaline degreasing was performed, "Palclean N364S" available from Nihon Parkerizing Co., Ltd., which is a silicate-based alkaline degreasing agent, was adjusted to have a concentration of 2% and a temperature of 60° C., and this silicate-based alkaline degreasing agent was then sprayed on the surface of the plated steel sheet for 10 seconds. Subsequently, after the surface of the plated steel sheet was washed with tap water, the washed plated steel sheet was wiped with a draining roll, and then further heated and dried at 50° C. for 30 seconds.

(3) Raw Material of Aqueous Surface Regulator (a1) to (a7) shown in Table 2 below were prepared as the basic compound (A).

TABLE 2

| | Basic compound of transition metal |
|---|---|
| a1 | ammonium zirconium carbonate |
| a2 | potassium zirconyl carbonate |
| a3 | sodium zirconium carbonate |
| a4 | diethanolamine salt of zirconium carbonate |
| a5 | ammonium molybdate |
| a6 | niobium (V) chloride |
| a7 | vanadium (III) chloride |

(b1) to (b5) shown in Table 3 below were prepared as the cobalt compound (B).

TABLE 3

| | Cobalt compound |
|---|---|
| b1 | cobalt (II) nitrate |
| b2 | cobalt (II) sulfate |
| b3 | cobalt (II) chloride |
| b4 | cobalt (II) acetylacetonate |
| b5 | cobalt (III) ethylenediaminetetraacetate |

Examples 1 to 63, and Comparative Examples 1 to 9

One or more or none of predetermined basic compounds (A) shown in Table 4, one or none of predetermined cobalt compounds (B) shown in Table 5, and deionized water were mixed, and ammonia or ammonium nitrate was then added to the resultant mixture as necessary to adjust the pH thereof. According to this manner, aqueous surface regulators used in Examples 1 to 63 and Comparative Examples 1 to 9 were obtained.

Any of the above-described aqueous surface regulators was then applied to any of the plated steel sheets No. 1 to No. 20 shown in Table 1, using a bar coater. In order to obtain a covering film amount of a predetermined covering film, the concentration of the aqueous surface regulator was adjusted and the type of bar coater was selected. Subsequently, the plated steel sheets were heated in an atmosphere of 200° C. to achieve the peak metal temperatures (PMT) shown in Tables 4 and 5 so as to be dried. Accordingly, the covering films having covering film amounts shown in Tables 4 and 5 were formed to obtain aluminum-zinc plated steel sheets. Note that in Tables 4 and 5, "transition metal amount" and "Co amount" respectively indicate "the amount in terms of mass of transition metal in a covering film per one side of a plated steel sheet" and "the amount in terms of mass of cobalt in the covering film per one side of a plated steel sheet".

TABLE 4

| | | | Aqueous surface regulator | | | | Covering film formation condition | | | | |
|---|---|---|---|---|---|---|---|---|---|---|---|
| | | Plated steel sheet No. | Basic compound (A) Type | Cobalt compound (B) Type | Component ratio Co/(A) mass ratio | pH | Covering film amount g/m$^2$ | Transition metal Type | Transition metal amount mg/m$^2$ | Co amount mg/m$^2$ | PMT (° C.) |
| Example | 1 | No. 3 | a1 | b1 | 1/100 | 9 | 0.2 | Zr | 60 | 2 | 50 |
| | 2 | No. 3 | a1 | b2 | 1/100 | 9 | 0.2 | Zr | 60 | 2 | 50 |
| | 3 | No. 3 | a1 | b3 | 1/100 | 9 | 0.2 | Zr | 60 | 2 | 50 |
| | 4 | No. 3 | a1 | b4 | 1/100 | 9 | 0.2 | Zr | 60 | 2 | 50 |
| | 5 | No. 3 | a1 | b5 | 1/100 | 9 | 0.2 | Zr | 60 | 2 | 50 |
| | 6 | No. 3 | a2 | b1 | 1/100 | 9 | 0.2 | Zr | 60 | 2 | 50 |
| | 7 | No. 3 | a2 | b2 | 1/100 | 9 | 0.2 | Zr | 60 | 2 | 50 |
| | 8 | No. 3 | a2 | b3 | 1/100 | 9 | 0.2 | Zr | 60 | 2 | 50 |
| | 9 | No. 3 | a2 | b4 | 1/100 | 9 | 0.2 | Zr | 60 | 2 | 50 |
| | 10 | No. 3 | a2 | b5 | 1/100 | 9 | 0.2 | Zr | 60 | 2 | 50 |
| | 11 | No. 3 | a3 | b1 | 1/100 | 9 | 0.2 | Zr | 60 | 2 | 50 |
| | 12 | No. 3 | a3 | b2 | 1/100 | 9 | 0.2 | Zr | 60 | 2 | 50 |
| | 13 | No. 3 | a3 | b3 | 1/100 | 9 | 0.2 | Zr | 60 | 2 | 50 |
| | 14 | No. 3 | a3 | b4 | 1/100 | 9 | 0.2 | Zr | 60 | 2 | 50 |
| | 15 | No. 3 | a3 | b5 | 1/100 | 9 | 0.2 | Zr | 60 | 2 | 50 |
| | 16 | No. 3 | a4 | b1 | 1/100 | 9 | 0.3 | Zr | 60 | 2 | 50 |
| | 17 | No. 3 | a1 | b1 | 1/10 | 9 | 0.3 | Zr | 60 | 20 | 50 |
| | 18 | No. 3 | a1 | b1 | 1/40 | 9 | 0.2 | Zr | 60 | 4.6 | 50 |
| | 19 | No. 3 | a1 | b1 | 1/300 | 9 | 0.2 | Zr | 60 | 0.6 | 50 |
| | 20 | No. 3 | a1 | b1 | 1/1000 | 9 | 0.2 | Zr | 60 | 0.18 | 50 |
| | 21 | No. 3 | a1 | b1 | 1/185 | 9 | 0.2 | Zr | 60 | 1 | 50 |
| | 22 | No. 3 | a1 | b1 | 1/14 | 9 | 0.2 | Zr | 60 | 13 | 50 |
| | 23 | No. 3 | a1 | b1 | 1/10 | 9 | 0.2 | Zr | 60 | 18 | 50 |
| | 24 | No. 3 | a1 | b1 | 1/12 | 9 | 0.01 | Zr | 4 | 1 | 50 |
| | 25 | No. 3 | a1 | b1 | 1/100 | 9 | 0.05 | Zr | 20 | 1 | 50 |
| | 26 | No. 3 | a1 | b1 | 1/100 | 9 | 0.8 | Zr | 240 | 8 | 50 |
| | 27 | No. 3 | a1 | b1 | 1/154 | 9 | 1.3 | Zr | 400 | 8 | 50 |
| | 28 | No. 3 | a1 | b1 | 1/100 | 10 | 0.2 | Zr | 60 | 2 | 50 |
| | 29 | No. 3 | a1 | b1 | 1/100 | 9.5 | 0.2 | Zr | 60 | 2 | 50 |
| | 30 | No. 3 | a1 | b1 | 1/100 | 7.7 | 0.2 | Zr | 60 | 2 | 50 |
| | 31 | No. 3 | a1 | b1 | 1/100 | 7.5 | 0.2 | Zr | 60 | 2 | 50 |
| | 32 | No. 3 | a1 | b1 | 1/100 | 10.5 | 0.2 | Zr | 60 | 2 | 50 |
| | 33 | No. 3 | a1 | b1 | 1/100 | 7.2 | 0.2 | Zr | 60 | 2 | 50 |
| | 34 | No. 3 | a1 | b1 | 1/100 | 9 | 0.2 | Zr | 60 | 2 | 200 |
| | 35 | No. 3 | a1 | b1 | 1/100 | 9 | 0.2 | Zr | 60 | 2 | 150 |
| | 36 | No. 3 | a1 | b1 | 1/100 | 9 | 0.2 | Zr | 60 | 2 | 40 |
| | 37 | No. 1 | a1 | b1 | 1/100 | 9 | 0.2 | Zr | 60 | 2 | 50 |
| | 38 | No. 2 | a1 | b1 | 1/100 | 9 | 0.2 | Zr | 60 | 2 | 50 |
| | 39 | No. 4 | a1 | b1 | 1/100 | 9 | 0.2 | Zr | 60 | 2 | 50 |
| | 40 | No. 5 | a1 | b1 | 1/100 | 9 | 0.2 | Zr | 60 | 2 | 50 |

TABLE 5

| | | | Aqueous surface regulator | | | | Covering film formation condition | | | | |
|---|---|---|---|---|---|---|---|---|---|---|---|
| | | Plated steel sheet No. | Basic compound (A) Type | Cobalt compound (B) Type | Component ratio Co/(A) mass ratio | pH | Covering film amount g/m$^2$ | Transition metal Type | Transition metal amount mg/m$^2$ | Co amount mg/m$^2$ | PMT (° C.) |
| Example | 41 | No. 6 | a1 | b1 | 1/100 | 9 | 0.2 | Zr | 60 | 2 | 50 |
| | 42 | No. 7 | a1 | b1 | 1/100 | 9 | 0.2 | Zr | 60 | 2 | 50 |

TABLE 5-continued

| | | Aqueous surface regulator | | | | Covering film formation condition | | | | |
|---|---|---|---|---|---|---|---|---|---|---|
| | Plated steel sheet No. | Basic compound (A) Type | Cobalt compound (B) Type | Component ratio Co/(A) mass ratio | pH | Covering film amount g/m$^2$ | Transition metal Type | Transition metal amount mg/m$^2$ | Co amount mg/m$^2$ | PMT (° C.) |
| | 43 No. 8 | a1 | b1 | 1/100 | 9 | 0.2 | Zr | 60 | 2 | 50 |
| | 44 No. 9 | a1 | b1 | 1/100 | 9 | 0.2 | Zr | 60 | 2 | 50 |
| | 45 No. 10 | a1 | b1 | 1/100 | 9 | 0.2 | Zr | 60 | 2 | 50 |
| | 46 No. 11 | a1 | b1 | 1/100 | 9 | 0.2 | Zr | 60 | 2 | 50 |
| | 47 No. 12 | a1 | b1 | 1/100 | 9 | 0.2 | Zr | 60 | 2 | 50 |
| | 48 No. 13 | a1 | b1 | 1/100 | 9 | 0.2 | Zr | 60 | 2 | 50 |
| | 49 No. 14 | a1 | b1 | 1/100 | 9 | 0.2 | Zr | 60 | 2 | 50 |
| | 50 No. 15 | a1 | b1 | 1/100 | 9 | 0.2 | Zr | 60 | 2 | 50 |
| | 51 No. 16 | a1 | b1 | 1/100 | 9 | 0.2 | Zr | 60 | 2 | 50 |
| | 52 No. 17 | a1 | b1 | 1/100 | 9 | 0.2 | Zr | 60 | 2 | 50 |
| | 53 No. 18 | a1 | b1 | 1/100 | 9 | 0.2 | Zr | 60 | 2 | 50 |
| | 54 No. 19 | a1 | b1 | 1/100 | 9 | 0.2 | Zr | 60 | 2 | 50 |
| | 55 No. 20 | a1 | b1 | 1/100 | 9 | 0.2 | Zr | 60 | 2 | 50 |
| | 56 No. 3 | a5 | b1 | 1/62 | 9 | 0.1 | Mo | 60 | 2 | 50 |
| | 57 No. 3 | a6 | b1 | 1/87 | 9 | 0.2 | Nb | 60 | 2 | 50 |
| | 58 No. 3 | a7 | b1 | 1/93 | 9 | 0.2 | V | 60 | 2 | 50 |
| | 59 No. 3 | a1 + a5 | b1 | 1/87 | 9 | 0.2 | Zr, Mo | Zr; 50 Mo; 10 | 2 | 50 |
| | 60 No. 3 | a1 + a6 | b1 | 1/92 | 9 | 0.2 | Zr, Nb | Zr; 50 Nb; 10 | 2 | 50 |
| | 61 No. 3 | a1 + a7 | b1 | 1/80 | 9 | 0.2 | Zr, V | Zr; 50 V; 10 | 2 | 50 |
| | 62 No. 3 | a5 | b1 | 1/14 | 9 | 0.03 | Mo | 10 | 2 | 50 |
| | 63 No. 3 | a5 | b1 | 1/310 | 9 | 0.6 | Mo | 300 | 2 | 50 |
| Comparative example | 1 No. 3 | a1 | — | — | 9.5 | 0.2 | Zr | 60 | — | 50 |
| | 2 No. 3 | — | b1 | — | 2 | 0.05 | — | — | 20 | 50 |
| | 3 No. 3 | a1 | b1 | 1/7 | 9.2 | 0.2 | Zr | 60 | 50 | 50 |
| | 4 No. 3 | a1 | b1 | 1/2000 | 9.5 | 0.2 | Zr | 60 | 0.01 | 50 |
| | 5 No. 3 | a1 | b1 | 1/100 | 6.5 | 0.2 | Zr | 60 | 2 | 50 |
| | 6 No. 3 | a1 | b1 | 1/900 | 9 | 0.3 | Zr | 600 | 2 | 50 |
| | 7 No. 3 | a1 | b1 | 1/5 | 9 | 0.005 | Zr | 0.5 | 1 | 50 |
| | 8 No. 3 | a5 | b1 | 1/600 | 9 | 1.2 | Mo | 600 | 2 | 50 |
| | 9 No. 3 | a5 | b1 | 1/4 | 9 | 0.007 | Mo | 0.5 | 2 | 50 |
| | 10 No. 3 | — | — | — | — | 2.0 | — | — | — | 120 |
| | 11 No. 3 | — | — | — | — | 3.5 | Zr, Ti | — | — | 100 |
| | 12 No. 3 | — | — | — | — | 5.8 | Zr, V | — | — | 100 |
| | 13 No. 16 | — | — | — | — | — | | — | — | |
| | 14 No. 19 | — | — | — | — | — | | — | — | — |
| | 15 No. 20 | — | — | — | — | — | | — | — | — |

Comparative Example 10

A prepolymer obtained through reaction of 120 parts of a polyester resin having carboxyl group at both ens and having a number-average molecular weight of 1000, 90 parts of polyethylene glycol having hydroxyl groups at both ends and having a number-average molecular weight of 1000, 12 parts of 2,2-dimethylolpropionic acid, 80 parts of dicyclohexylmethane diisocyanate, and 120 parts of N-methyl-2-pyrrolidone was dispersed into deionized water to obtain a prototype urethane resin which has 0.30 meq/g for carboxylic acid equivalent, 0.79 meq/g for acid amine equivalent, and 2.5 meq/g for resin/N-methylpyrrolidone.

At room temperature, 1000 parts of the prototype urethane resin was added to distilled water, 20 parts of ammonium zirconium carbonate and 2 parts of vinyltrimethoxysilane were then added thereto, and then the resultant mixture was stirred using a propeller stirrer to prepare a surface regulator.

This surface regulator was then applied onto the plated steel sheet No. 3 shown in Table 1, with a bar coater. In order to obtain a covering film amount of a predetermined covering film, the concentration of the surface regulator was adjusted and the type of bar coater was selected. This plated steel sheet was then heated in an atmosphere of 200° C. to have a peak metal temperature (PMT) of 120° C. so as to be dried. Accordingly, the covering film having a covering film amount shown in Table 5 was formed. Accordingly, an aluminum-zinc plated steel sheet was obtained.

Comparative Example 11

At room temperature, 3.0 g/L of fluorotitanic acid, 2.0 g/L of fluorozirconic acid, 1.8 g/L of 30% hydrogen peroxide water, and 1.8 g/L of pyrophosphoric acid were added to distilled water, the pH of the resultant mixture was adjusted to 3.5 with sodium hydroxide, and then the mixture was heated to 45° C. to prepare a surface regulator.

The plated steel sheet No. 3 shown in Table 1 was immersed in this surface regulator. After the plated steel sheet was immersed in the aqueous surface regulator for 10 seconds, the plated steel sheet was washed with deionized water for 10 seconds, and then dried in an atmosphere of 100° C. until the peak metal temperature reached 100° C. Accordingly, the covering film having a covering film amount shown in Table 5 was formed. Accordingly, an aluminum-zinc plated steel sheet was obtained.

Comparative Example 12

At room temperature, 0.1 parts of vanadium acetylacetate, 1 part of vanadyl acetylcetonate, and 1.5 parts of 20% fluorozirconic acid were added to 1000 parts of distilled water, and then the pH of the mixture was adjusted to 5.8 using 25% ammonia water to prepare a surface regulator.

The plated steel sheet No. 3 shown in Table 1 was immersed in this surface regulator. After the plated steel sheet was immersed in the surface regulator for 90 seconds, the plated steel sheet was washed with water for 10 seconds, and then dried in an atmosphere of 100° C. until the peak metal temperature reached 100° C. Accordingly, the covering film having a covering film amount shown in Table 5 was formed. Accordingly, an aluminum-zinc plated steel sheet was obtained.

Comparative Examples 13 to 15

Plated steel sheets No. 16 (comparative example 13), No. 19 (comparative example 14), and No. 20 (comparative example 15) were not covered with any covering film, and subjected to evaluation described later.

[Evaluation Method]

The aluminum-zinc plated steel sheets (comparative example 13 to 15 did not have covering film) of Examples and Comparative Examples shown in Tables 4 and 5 were cut to produce test sheets having a size of 150 mm×70 mm, and the following tests were carried out. Each evaluation method will be described below.

[Corrosion Resistance]

Salt water was sprayed on the test sheets for 72 hours or 120 hours based on a salt spray test method (JIS-Z-2371). Subsequently, the area where white rust formed was visually checked, and evaluation was made based on the following evaluation criteria. Note that, in this corrosion resistance evaluation, the result indicative of "3" or more for 72 hours means that the corrosion resistance reaches the level of practical use in temporal rust prevention application. In the corrosion resistance evaluation, the result indicative of "3" or more for 120 hours means that the corrosion resistance reaches the level of use in temporal rust prevention applications that need higher corrosion resistance.

4; white rust formation area percentage is less than 3%,

3; white rust formation area percentage is not less than 3% and is less than 10%, 2; white rust formation area percentage is not less than 10% and is less than 30%, and 1; white rust formation area percentage is not less than 30%.

[Blackening Resistance]

The test sheets were left in boiled deionized water for 30 minutes. Subsequently, the area where white rust formed was visually checked, and evaluation was made based on the following evaluation criteria. Note that, in the blackening resistance evaluation, the result indicative of "3" or more means that the blackening resistance reaches the level of practical use.

4; no change,

3; white rust formation area percentage is less than 3%,

2; white rust formation area percentage is not less than 3% and is less than 30%, and 1; white rust formation area percentage is not less than 30%.

[Alkali-Resistance]

"Palclean N364S" available from Nihon Parkerizing Co., Ltd., which is an alkaline degreasing agent, was adjusted to have a concentration of 2% and a temperature of 60° C., sprayed on the surface of the test sheet for 2 minutes, washed with deionized water, and then dried with a dryer. Subsequently, the area where white rust formed was visually checked, and evaluation was made based on the following evaluation criteria. Note that, in the alkali-resistance evaluation, the result indicative of "3" or more means that the alkali-resistance reaches the level of practical use.

4; white rust formation area percentage is less than 3%,

3; white rust formation area percentage is not less than 3% and is less than 10%, 2; white rust formation area percentage is not less than 10% and is less than 30%, and 1; white rust formation area percentage is not less than 30%.

[Condensation Resistance]

1 mL of deionized water was dropped on the surface of the test sheet, and left to stand for one day at room temperature until water was completely volatilized. Discoloration degree after this test was visually checked, and evaluation was made based on the following evaluation criteria. Note that, in the condensation resistance evaluation, the result indicative of "3" or more means that the condensation resistance reaches the level of practical use.

4; no change,

3; white rust formation area percentage is less than 1%,

2; white rust formation area percentage is not less than 1% and is less than 30%, and 1; white rust formation area percentage is not less than 30%.

[Coating Film Adherence]

Painting was performed on the covering films of the test sheets under conditions, which will be described below, to obtain painted sheets.

(1) Alkyd paint: brand name "DELICON #700" available from Dai Nippon Toryo Co., Ltd., painting: bar-coating method, baking condition: 140° C. for 20 minutes, dried coating film thickness 25 μm.

(2) Clear coating: brand name "V-FLON #2000FC2" available from Dai Nippon Toryo Co., Ltd., painting: bar-coating method, baking condition: 200° C. for 20 minutes, dried coating film thickness 20 μm.

Next, 100 squares each having a size of 1 mm×1 mm were made by cutting the coating film of the above-described painted sheet but not cutting the covering film with an NT cutter. Subsequently, peeling was performed with cellophane tape, and evaluation was made based on the number of remaining coating films based on the following determination criteria. In the coating film adhesion evaluation, the result indicative of "3" or more means that the coating film adhesion reaches the level of practical use.

4: 100,

3: not less than 98 and less than 100,

2: not less than 50 and less than 98, and

1: less than 50.

[Heat Discoloration Resistance]

Test sheets were heated at 200° C. for 20 minutes.

Color tone measurement was performed on the heated test sheets and test sheets prior to the heating treatment based on the L*a*b* color system (JIS Z 8729). The color tone measurement was performed with a spectrophotometer (model number "SC-T45") available from Suga Test Instruments Co., Ltd.

Based on this result, a color difference in test sheets before and after the heat treatment was calculated by the following equation in accordance with JIS Z 8730.

$$\Delta E=\{(\Delta L^*)^2+(\Delta a^*)^2+(\Delta b^*)^2\}^{1/2}$$

$$\Delta L^*=L1^*-L2^*,\Delta a^*=a1^*-a2^*,\Delta b^*=b1^*-b2^*.$$

Note that ΔE is a color difference in test sheets before the heat treatment test and after the heat treatment, L1*, a1*, and b1* are respectively measurement values of L*, a*, and b* of the test sheets before the treatment, and L2*, a2*, and b2* are respectively measurement values of L*, a*, and b* of the test sheets after the treatment.

Based on this result, the heat discoloration resistance was evaluated as follows. Note that, in the heat discoloration resistance evaluation, the result indicative of "3" or more means that the heat discoloration resistance reaches the level of practical use.

4: ΔE is less than 2,

3: ΔE is not less than 2 and is less than 5,

2: ΔE is not less than 5 and is less than 10, and

1: ΔE is not less than 10.

TABLE 6

| | | Evaluation result | | | | | | | |
|---|---|---|---|---|---|---|---|---|---|
| | | Corrosion resistance | | | | | Coating film adherence | | Heat |
| | | 72 hr | 120 hr | Blackening resistance | Alkali-resistance | Condensation resistance | Solvent-based paint | Clear coating | discoloration resistance |
| Example | 1 | 4 | 4 | 4 | 4 | 4 | 4 | 4 | 4 |
| | 2 | 3 | 2 | 3 | 4 | 4 | 4 | 4 | 4 |
| | 3 | 3 | 2 | 4 | 4 | 4 | 4 | 4 | 4 |
| | 4 | 3 | 2 | 4 | 4 | 3 | 4 | 4 | 4 |
| | 5 | 3 | 2 | 3 | 3 | 3 | 4 | 4 | 3 |
| | 6 | 3 | 2 | 4 | 4 | 3 | 3 | 3 | 4 |
| | 7 | 3 | 2 | 3 | 4 | 3 | 3 | 3 | 4 |
| | 8 | 3 | 2 | 4 | 4 | 3 | 3 | 3 | 4 |
| | 9 | 3 | 2 | 4 | 4 | 3 | 3 | 3 | 4 |
| | 10 | 3 | 2 | 3 | 3 | 3 | 3 | 3 | 3 |
| | 11 | 3 | 2 | 4 | 4 | 3 | 3 | 3 | 4 |
| | 12 | 3 | 2 | 3 | 4 | 3 | 3 | 3 | 4 |
| | 13 | 3 | 2 | 4 | 4 | 3 | 3 | 3 | 4 |
| | 14 | 3 | 2 | 4 | 4 | 3 | 3 | 3 | 4 |
| | 15 | 3 | 2 | 3 | 3 | 3 | 3 | 3 | 3 |
| | 16 | 3 | 2 | 4 | 3 | 3 | 3 | 3 | 3 |
| | 17 | 3 | 2 | 3 | 4 | 3 | 4 | 4 | 4 |
| | 18 | 4 | 3 | 4 | 4 | 3 | 4 | 4 | 4 |
| | 19 | 4 | 3 | 4 | 4 | 3 | 4 | 4 | 4 |
| | 20 | 4 | 3 | 4 | 4 | 3 | 4 | 4 | 4 |
| | 21 | 4 | 3 | 3 | 3 | 3 | 4 | 4 | 3 |
| | 22 | 4 | 3 | 3 | 3 | 3 | 4 | 4 | 3 |
| | 23 | 4 | 3 | 3 | 3 | 3 | 4 | 4 | 3 |
| | 24 | 3 | 2 | 4 | 3 | 3 | 4 | 4 | 3 |
| | 25 | 4 | 3 | 4 | 3 | 3 | 4 | 4 | 3 |
| | 26 | 4 | 3 | 4 | 3 | 3 | 4 | 4 | 3 |
| | 27 | 3 | 2 | 4 | 3 | 3 | 4 | 4 | 3 |
| | 28 | 3 | 3 | 4 | 3 | 3 | 4 | 4 | 3 |
| | 29 | 4 | 3 | 4 | 4 | 4 | 4 | 4 | 4 |
| | 30 | 3 | 3 | 3 | 4 | 4 | 4 | 4 | 4 |
| | 31 | 3 | 3 | 3 | 3 | 3 | 4 | 4 | 3 |
| | 32 | 4 | 3 | 4 | 4 | 4 | 4 | 4 | 4 |
| | 33 | 3 | 2 | 3 | 3 | 3 | 4 | 4 | 3 |
| | 34 | 3 | 2 | 3 | 3 | 3 | 4 | 4 | 3 |
| | 35 | 4 | 3 | 4 | 4 | 4 | 4 | 4 | 4 |
| | 36 | 4 | 3 | 4 | 4 | 4 | 4 | 4 | 4 |
| | 37 | 4 | 3 | 4 | 3 | 4 | 4 | 4 | 4 |
| | 38 | 4 | 4 | 4 | 4 | 4 | 4 | 4 | 4 |
| | 39 | 4 | 4 | 3 | 4 | 4 | 4 | 4 | 4 |
| | 40 | 4 | 4 | 4 | 4 | 4 | 4 | 4 | 4 |

TABLE 7

| | | Evaluation result | | | | | | | |
|---|---|---|---|---|---|---|---|---|---|
| | | Corrosion resistance | | | | | Coating film adherence | | Heat |
| | | 72 hr | 120 hr | Blakening resistance | Alkali-resistance | Condensation resistance | Solvent-based paint | Clear coating | discoloration resistance |
| Example | 41 | 4 | 4 | 4 | 4 | 4 | 4 | 4 | 4 |
| | 42 | 4 | 4 | 4 | 4 | 4 | 4 | 4 | 4 |
| | 43 | 4 | 4 | 4 | 4 | 4 | 4 | 4 | 4 |
| | 44 | 4 | 4 | 4 | 4 | 4 | 4 | 4 | 4 |
| | 45 | 4 | 4 | 4 | 4 | 4 | 4 | 4 | 4 |
| | 46 | 4 | 4 | 4 | 4 | 4 | 4 | 4 | 4 |
| | 47 | 4 | 4 | 4 | 4 | 4 | 4 | 4 | 4 |
| | 48 | 4 | 4 | 4 | 4 | 4 | 4 | 4 | 4 |
| | 49 | 4 | 4 | 4 | 4 | 4 | 4 | 4 | 4 |

TABLE 7-continued

| | | Evaluation result | | | | | | | |
|---|---|---|---|---|---|---|---|---|---|
| | | Corrosion resistance | | | | | Coating film adherence | | Heat |
| | | 72 hr | 120 hr | Blakening resistance | Alkali-resistance | Condensation resistance | Solvent-based paint | Clear coating | discoloration resistance |
| | 50 | 4 | 4 | 4 | 4 | 4 | 4 | 4 | 4 |
| | 51 | 4 | 4 | 4 | 4 | 4 | 4 | 4 | 4 |
| | 52 | 4 | 4 | 4 | 4 | 4 | 4 | 4 | 4 |
| | 53 | 4 | 4 | 4 | 4 | 4 | 4 | 4 | 4 |
| | 54 | 4 | 4 | 4 | 4 | 4 | 4 | 4 | 4 |
| | 55 | 3 | 2 | 4 | 4 | 4 | 4 | 4 | 4 |
| | 56 | 3 | 2 | 3 | 3 | 3 | 3 | 3 | 3 |
| | 57 | 3 | 2 | 3 | 3 | 3 | 3 | 3 | 3 |
| | 58 | 3 | 2 | 3 | 3 | 3 | 3 | 3 | 3 |
| | 59 | 3 | 2 | 3 | 3 | 3 | 3 | 3 | 3 |
| | 60 | 3 | 3 | 3 | 3 | 3 | 3 | 3 | 3 |
| | 61 | 3 | 2 | 3 | 3 | 3 | 3 | 3 | 3 |
| | 62 | 3 | 2 | 3 | 3 | 3 | 3 | 3 | 3 |
| | 63 | 3 | 3 | 3 | 3 | 3 | 3 | 3 | 3 |
| Comparative example | 1 | 4 | 4 | 1 | 3 | 1 | 4 | 4 | 3 |
| | 2 | 1 | 1 | 2 | 1 | 1 | 4 | 4 | 1 |
| | 3 | 2 | 1 | 3 | 3 | 3 | 4 | 4 | 3 |
| | 4 | 4 | 4 | 2 | 3 | 3 | 4 | 4 | 2 |
| | 5 | 3 | 2 | 1 | 2 | 2 | 2 | 2 | 3 |
| | 6 | 3 | 2 | 2 | 2 | 2 | 2 | 2 | 3 |
| | 7 | 1 | 1 | 1 | 1 | 1 | 2 | 2 | 2 |
| | 8 | 2 | 1 | 1 | 1 | 1 | 2 | 2 | 2 |
| | 9 | 1 | 1 | 1 | 1 | 1 | 2 | 2 | 2 |
| | 10 | 4 | 4 | 2 | 2 | 2 | 4 | 4 | 1 |
| | 11 | 2 | 1 | 3 | 1 | 3 | 3 | 3 | 3 |
| | 12 | 2 | 1 | 3 | 1 | 3 | 3 | 3 | 3 |
| | 13 | 2 | 1 | 2 | 2 | 2 | 3 | 3 | 4 |
| | 14 | 2 | 1 | 1 | 1 | 1 | 3 | 3 | 4 |
| | 15 | 1 | 1 | 1 | 2 | 1 | 3 | 3 | 4 |

As can be understood from evaluation results shown in Tables 6 and 7, the aluminum-zinc plated steel sheets according to the embodiment of the present invention shown in Examples 1 to 63 had excellent corrosion resistance, blackening resistance, condensation resistance, alkali-resistance, coating film adherence, and heat discoloration resistance.

On the other hand, Comparative Example 1 which corresponds to the test sheet including the covering film made from only the basic compound (A) and Comparative Example 2 which corresponds to the test sheet including the covering film made from only the cobalt compound (B) are poor in any of their capabilities, and thus are not in practical level.

Also, Comparative Example 3, in which the amount in terms of mass of cobalt in the covering film per one side of the plated steel sheet was greater than the prescribed range, is poor in the corrosion resistance. Furthermore, Comparative Example 4, in which the amount in terms of mass of cobalt in the covering film per one side of the plated steel sheet was less than the prescribed range, is poor in blackening resistance and heat discoloration resistance.

Comparative Example 5, in which the aqueous surface regulator had a pH of 6.5, Comparative Examples 6 and 8 whose amount in terms of mass of transition metal was high, and Comparative Examples 7 and 9 whose amount in terms of mass of transition metal was low, are poor in corrosion resistance, blackening resistance, alkali-resistance, and condensation resistance.

Any of the abilities of Comparative Examples 10 to 12 whose covering films were formed from known surface regulators different from the aqueous surface regulator used in the present invention are poor in any of their capabilities. Comparative Examples 13 to 15 are devoid of the covering films and therefore are poor in corrosion resistance and blackening resistance.

[Covering Film Composition Evaluation]

The covering films of the aluminum-zinc plated steel sheets in the Examples were analyzed with X-ray photoelectron spectroscopy. As a result, it was confirmed that cobalt hydroxide and cobalt oxide were present near the surface of the covering film, and metallic cobalt was present in a region near the surface of the covering film, and also present in a region far from the surface of the covering film. It was also confirmed that oxides and hydroxides of transition metal were present in a region near the surface of the covering film and also present in a region far from the surface of the covering film.

Figure 2:
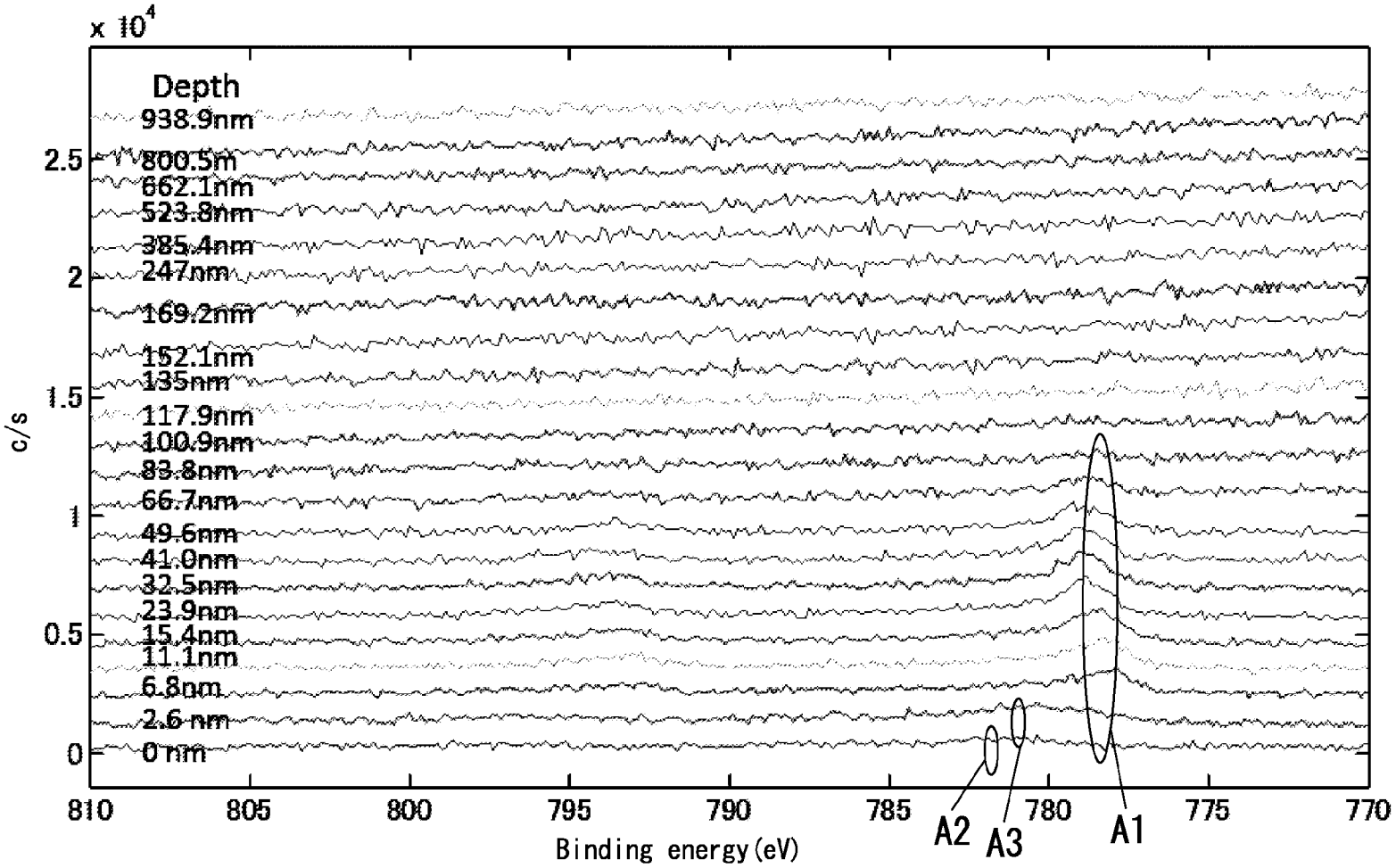
FIG. 2 is a graph showing a chart obtained by analyzing a covering film of an aluminum-zinc plated steel sheet of Example 1 of the present invention using X-ray photoelectron spectroscopy.
Figure 3:
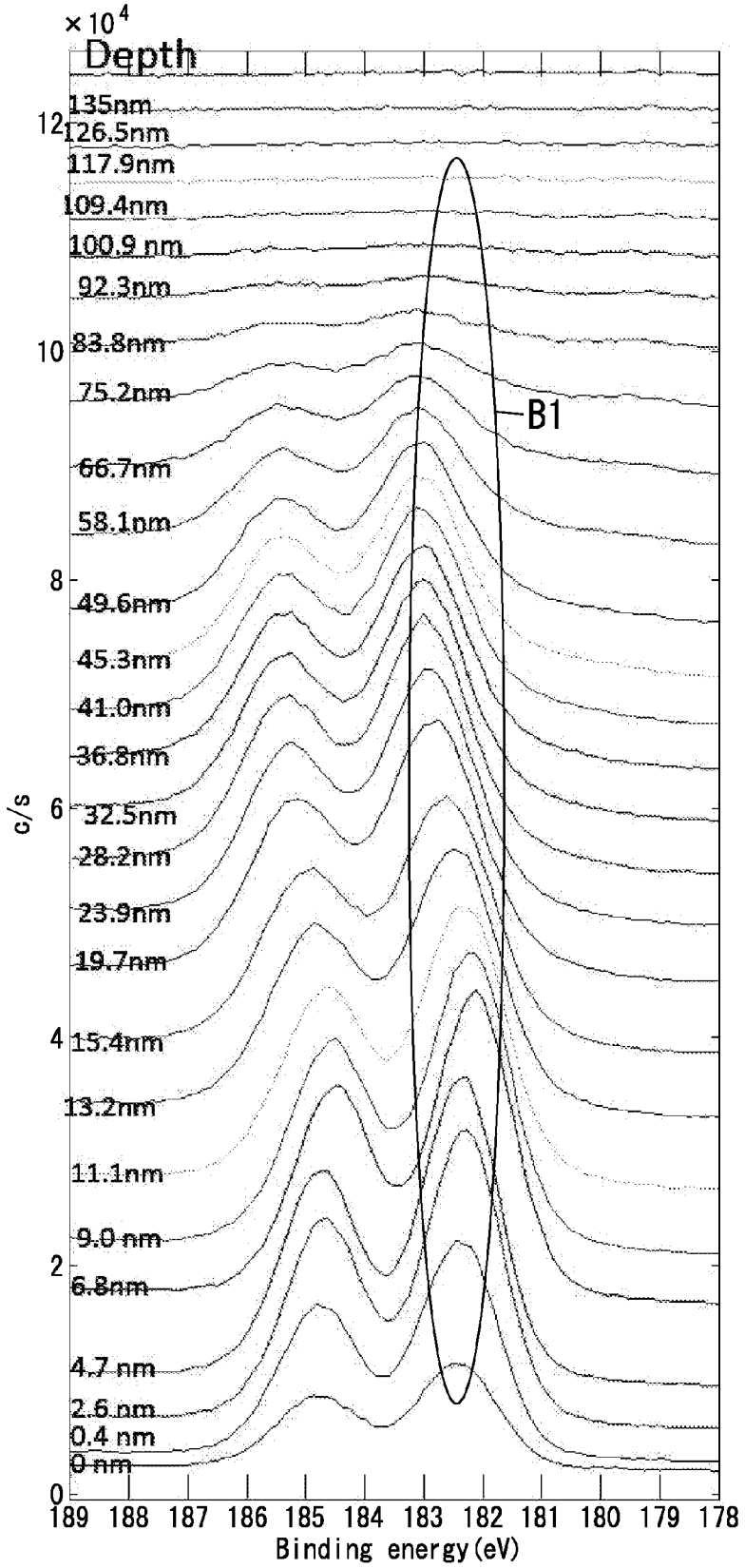
FIG. 3 is a graph showing another chart obtained by analyzing the covering film of the aluminum-zinc plated steel sheet of Example 1 of the present invention using X-ray photoelectron spectroscopy.
Figure 4:
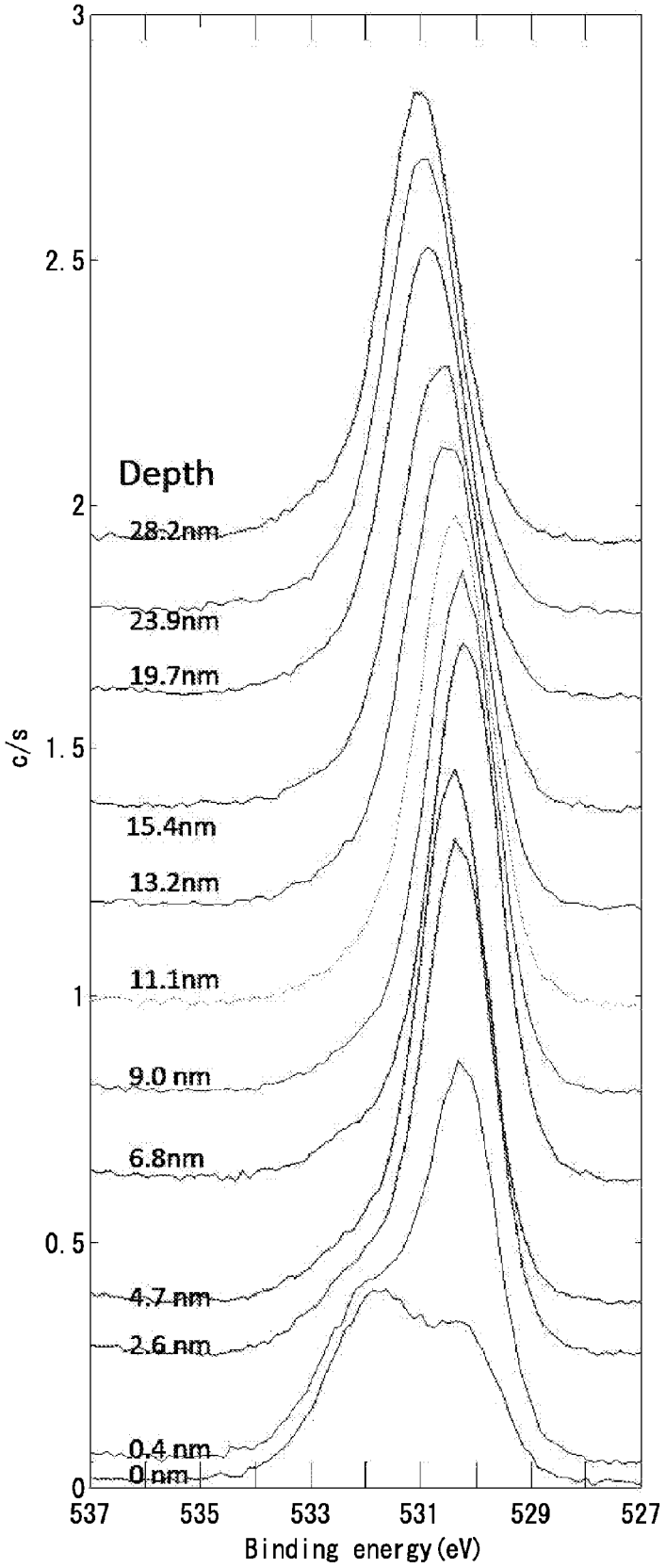
FIG. 4 is a graph showing another chart obtained by analyzing the covering film of the aluminum-zinc plated steel sheet of Example 1 of the present invention using X-ray photoelectron spectroscopy.

FIGS. 2, 3, and 4 show charts obtained by analyzing the covering film in Example 1 with X-ray photoelectron spectroscopy. FIG. 2 shows that peaks indicating the presence of metallic cobalt are present in the region A1. According to this, it can be confirmed that metallic cobalt is present in a region extending from the surface to a depth of about 100 nm of the covering film. Note that it can be confirmed that cobalt hydroxide and cobalt oxide are present near the surface of the covering film because peaks indicating the presence of cobalt hydroxide and peaks indicating cobalt oxide are respectively detected in regions A2 and A3 shown in FIG. 2. Zr3d peaks indicating the presence of a Zr—O bond are detected in the region B1 shown in FIG. 3. Accordingly, it can be confirmed that zirconium hydroxide and zirconium oxide are present in a region extending from the surface to a depth of about 100 nm of the covering film. O1s peak (approximately 531.2 eV) in zirconium hydroxide and O1s peak (approximately 529.9 eV) in zirconium oxide can be detected in FIG. 4. Although these two peaks cannot be completely separated because they are close, according to the chart shown in FIG. 4, it can be found that zirconium hydroxide and zirconium oxide are present in a mixed manner, and the ratio of zirconium hydroxide at an internal portion of the covering film tends to increase with an increase in the distance of the internal portion from the surface of the covering film.

With Comparative Example 5, as a result of analyzing the covering film using X-ray photoelectron spectroscopy, metallic cobalt was not detected in the covering film. It is conceivable that this is because a reaction between a compound in the aqueous surface regulator and a component in the plating layer is unlikely to occur when the pH of the aqueous surface regulator is small like Comparative Example 5, and thus metallic cobalt is not deposited.

The invention claimed is:

1. A method for producing an aluminum-zinc plated steel sheet, comprising a step of forming a covering film not containing resin through applying an aqueous surface regulator onto a plated steel sheet and drying the aqueous surface regulator on the plated steel sheet, the aqueous surface regulator having a pH of 7.5 to 10 and containing a basic compound (A) of transition metal other than cobalt and chromium, a cobalt compound (B), and water, the basic compound (A) of the transition metal including at least one selected from a group consisting of ammonium salts, carbonates, chlorides, ammonium carbonate, alkali metal carbonates, amine salts, and diethanolamine salts, wherein the plated steel sheet includes a steel sheet and a plating layer, the plating layer containing zinc and aluminum, wherein a percentage of a total amount of a phosphorus compound and a fluorine compound in the covering film is 1% by mass or less, and wherein a mass ratio of an amount of cobalt contained in the cobalt compound (B) to a total amount of the basic compound (A) is within a range of 1/25 to 1/1000.

2. The method for producing the aluminum-zinc plated steel sheet according to claim 1, wherein a peak metal temperature of the plated steel sheet in drying the aqueous surface regulator on the plated steel sheet is within a range of 40 to 200° C.

3. The method for producing the aluminum-zinc plated steel sheet according to claim 1, wherein the aqueous surface regulator consists of the basic compound (A), the cobalt compound (B), water, and at least one of an acidic component and a basic component for adjusting a pH.

4. The aluminum-zinc plated steel sheet produced by the method according to claim 1, comprising:

the plated steel sheet including the steel sheet and the plating layer, and the covering film that covers the plated steel sheet, the covering film containing:

a basic compound of transition metal other than cobalt and chromium, derived from the basic compound (A) in the aqueous surface regulator; and metallic cobalt, or metallic cobalt and a cobalt compound, derived from the cobalt compound (B) in the aqueous surface regulator, the basic compound of the transition metal including at least one selected from a group consisting of ammonium salts, carbonates, chlorides, ammonium carbonate, alkali metal carbonates, amine salts, and diethanolamine salts, an amount of the covering film per one side of the plated steel sheet being within a range of 0.01 to 0.8 g/m$^2$, an amount in terms of mass of transition metal other than cobalt in the covering film per one side of the plated steel sheet being within a range of 4 to 400 mg/m$^2$, and an amount in terms of mass of cobalt in the covering film per one side of the plated steel sheet being within a range of 0.1 to 20 mg/m$^2$.

5. The aluminum-zinc plated steel sheet according to claim 4, wherein the amount in terms of mass of cobalt in the covering film is greater than 0.5 mg/m$^2$ and not greater than 20 mg/m$^2$.

6. The aluminum-zinc plated steel sheet according to claim 4, wherein a percentage of aluminum in the plating layer is within a range of 1% by mass to 75% by mass.

7. The aluminum-zinc plated steel sheet according to claim 6, wherein the plating layer contains magnesium, and a percentage of magnesium in the plating layer is greater than 0%/o by mass and not greater than 6.0% by mass.

8. The aluminum-zinc plated steel sheet according to claim 6, wherein the plating layer contains Si so that a percentage by mass of Si to aluminum in the plating layer is within a range of 0.1% to 10%.

9. The aluminum-zinc plated steel sheet according to claim 6, wherein the plating layer contains at least one of: Ni in an amount of greater than 0% by mass and not greater than 1% by mass of the plating layer; and Cr in an amount of greater than 0% by mass and not greater than 1% by mass of the plating layer.

10. The aluminum-zinc plated steel sheet according to claim 6, wherein the plating layer contains at least one of: Ca in an amount of greater than 0% by mass and not greater than 0.5% by mass of the plating layer; Sr in an amount of greater than 0% by mass and not greater than 0.5% by mass of the plating layer; Y in an amount of greater than 0% by mass and not greater than 0.5% by mass of the plating layer; La in an amount of greater than 0% by mass and not greater than 0.5% by mass of the plating layer; and Ce in an amount of greater than 0% by mass and not greater than 0.5% by mass of the plating layer.

11. The aluminum-zinc plated steel sheet according to claim 4, wherein the transition metal in the basic compound includes zirconium.

12. The aluminum-zinc plated steel sheet according to claim 4, wherein the transition metal in the basic compound is at least one selected from a group consisting of zirconium, vanadium, molybdenum, and niobium.

13. The aluminum-zinc plated steel sheet according to claim 4, wherein the basic compound of transition metal other than cobalt and chromium includes at least one selected from basic zirconium, basic zirconyl, basic zirconyl salts, basic zirconium carbonate, basic zirconyl carbonate, basic zirconium carbonate salts, and basic zirconyl carbonate salts.

14. The aluminum-zinc plated steel sheet according to claim 4, wherein the basic compound of transition metal other than cobalt and chromium includes at least one selected from ammonium zirconyl carbonate, potassium zirconyl carbonate, sodium zirconyl carbonate, ammonium zirconium carbonate, potassium zirconium carbonate, and sodium zirconium carbonate.

* * * * *